US006710533B2

(12) United States Patent
Miura et al.

(10) Patent No.: US 6,710,533 B2
(45) Date of Patent: Mar. 23, 2004

(54) FLAT CATHODE-RAY TUBE, ELECTRON GUN FOR FLAT CATHODE-RAY TUBE AND PRODUCING METHOD THEREOF

(75) Inventors: Jun Miura, Fukishima (JP); Koichi Furui, Kanagawa (JP)

(73) Assignee: Sony Corporation (JP)

( * ) Notice: Subject to any disclaimer, the term of this patent is extended or adjusted under 35 U.S.C. 154(b) by 115 days.

(21) Appl. No.: 09/893,000

(22) Filed: Jun. 28, 2001

(65) Prior Publication Data

US 2003/0020390 A1 Jan. 30, 2003

(30) Foreign Application Priority Data

Apr. 3, 2001 (JP) ..... P2001-105082

(51) Int. Cl.[7] ..... H01J 29/46

(52) U.S. Cl. ..... 313/442; 313/440; 313/441; 313/414

(58) Field of Search ..... 313/441, 442, 313/445, 446, 447, 409, 413, 414, 452, 453, 454, 455; 315/381, 382, 382.1

(56) References Cited

U.S. PATENT DOCUMENTS 3,875,446 A * 4/1975 Miyaoka ..... 313/414
5,412,277 A * 5/1995 Chen ..... 313/414

FOREIGN PATENT DOCUMENTS

EP 0567871 * 11/1993 ..... H01J/29/00

* cited by examiner

*Primary Examiner*—Vip Patel
(74) *Attorney, Agent, or Firm*—Rader, Fishman & Grauer PLLC; Ronald P. Kananen

(57) ABSTRACT

In a flat cathode-ray tube, there are problems that an axis of electron beam is separated before the electron beam enters a main lens due to magnetic field of a magnet disposed outside a neck, and coma aberration is generated to degrade an image quality. It is an object of the present invention to solve these problems. A flat cathode-ray tube comprises an electron gun 281 having a main lens 35M whose center coincides with a tube axis, a deflection yoke, and a magnet disposed outside a neck. An axis of a prefocus lens of the electron gun is separated from the tube axis.

6 Claims, 22 Drawing Sheets

FLAT CATHODE-RAY TUBE, ELECTRON GUN FOR FLAT CATHODE-RAY TUBE AND PRODUCING METHOD THEREOF

BACKGROUND OF THE INVENTION

1. Field of the Invention

The present invention relates to a flat cathode-ray tube, an electron gun used for the flat cathode-ray tube and a producing method of the gun.

2. Description of the Related Art

Conventionally, in the case of a flat cathode-ray tube, since the depth dimension thereof in a direction for watching a screen panel can be reduced, the flat cathode-ray tubes are preferably used for a portable television set, an in-car television set, a door phone and the like which require thin image receivers for example.

A conventional flat cathode-ray tube is shown in FIG. 1 and FIG. 2.

A flat cathode-ray tube 1 includes a glass tube body 7 comprising a front panel 2, a screen panel 4 formed with a fluorescent surface 3 and a funnel 6 having a neck 5 which are frit-jointed to one another. An electron gun 8 is disposed in the neck 5 of the funnel 6 such that a center axis of the electron gun 8 coincides with a tube axis 11 of the neck 5. A deflection yoke 14 having a horizontal deflection coil 12 and a vertical deflection coil 13 is provided outside from the neck 5 of the glass tube body 7 to the funnel 6. A magnet, a so-called centering magnet 9 for adjusting an electron beam such that the electron beam scans an effective screen, i.e., a fluorescent surface is disposed at a position closer to a front portion of the deflection yoke 14. The centering magnet 9 comprises two ring-like double-pole magnets (permanent magnets) 9*a* and 9*b*.

In the case of the deflection yoke 14, in view of costs and deflection sensibility, a saddle type coil is generally used as the horizontal deflection coil 12 and a toroidal type coil is generally used as the vertical deflection coil 13. An electron beam 15 emitted from an electron gun 13 is deflected in the vertical direction and radiates onto the fluorescent surface 3 of the screen panel 4. The electron beam 15 is deflected symmetrically with respect to the deflection center in the horizontal direction, but is deflected asymmetrically in the vertical direction.

The glass tube body 7 is formed to a flat shape such that the glass tube body 7 becomes longer in the lateral direction in a horizontally defecting direction. The screen panel 4 is disposed in an inclining manner such that the screen panel 4 crosses the tube axis 11 diagonally. An image formed on the screen panel 4 can be seen from the front panel 2. The front panel 2 is transparent and formed in a flat plate-like shape. The flat cathode-ray tube in this case is a reflective type tube. On the contrary, when the image on the screen panel 4 is seen from the side of the screen panel 4, the flat cathode-ray tube is a transparent type tube.

As shown in FIG. 4, the conventional flat cathode-ray tube 1 causes coma aberration which leaves a trail of light behind a luminescent spot on the screen panel 4 like mercury. A beam spot 17 is visually seen with halation, and image quality is degraded.

The present inventors researched a cause of degradation of this beam spot and as a result, they found that a magnetic field due to the centering magnet 9 on the side of the neck influences the beam spot. That is, by the effect of the magnetic field from the centering magnet 9, as shown in FIG. 3, the electron beam 15 is deflected before the beam 15 enters a main lens 16M, and the electron beam 15 is separated from the tube axis 11, i.e., a so-called "axis-separation" is generated. Since the axis-separation is generated on the side of a cathode K of the main lens 16M, the electron beam 15 radiates onto a position deviated from a center O of the main lens 16M. Therefore, the coma aberration is generated, the beam spot 17 attended with halation is generated, which degrades the image quality.

SUMMARY OF THE INVENTION

In view of the above circumstances, the present invention provides a flat cathode-ray tube, an electron gun used for the flat cathode-ray tube and a producing method of the gun capable of reducing the degradation of a beam spot caused by effect of a magnet.

A flat cathode-ray tube according to the present invention includes a magnet outside of a neck, and a prefocus lens of an electron gun is separated from the tube axis.

According to the flat cathode-ray tube, since an axis of the prefocus lens is separated in an opposite direction in correspondence with an axis-separating amount of the electron beam whose axis is separated by effect of the magnet outside the neck, the electron beam passing through the focus lens is moved in a direction opposite to the axis-separating direction caused by the magnet, the axis-separation and the axis-separating amount are offset by each other, and the electron beam passes through a center of the main lens.

An electron gun for a flat cathode-ray tube of the present invention comprises a cathode and a plurality of grids, characterized in that a prefocus lens is separated from a center axis of an electron gun in a direction in which an axis-separating amount of an electron beam caused by a magnetic field of a magnet which is disposed outside of a neck becomes smaller.

According to the electron gun for a flat cathode-ray tube of the invention, the prefocus lens is separated from the center axis of an electron gun in a direction in which the axis-separating amount of the electron beam caused by the magnetic field of the magnet which is disposed outside of the neck becomes smaller. Therefore, when the gun is used for the flat cathode-ray tube, the electron beam passing through the focus lens is moved in a direction opposite to the axis-separating direction caused by the magnetic field of the magnet, the axis-separation and the axis-separating amount are offset by each other, and the electron beam passes through a center of the main lens.

A producing method of an electron gun for a flat cathode-ray tube according to the present invention comprises the steps of: preparing a first grid having an electron beam through hole formed at a reference position and having a positioning hole formed at another reference position, and preparing a second grip having an electron beam through hole separated from a reference position by a predetermined distance and having a positioning hole formed at another reference position, and inserting positioning means in the positioning holes of the first and second grids for positioning the first and second grids in a state that a spacer is interposed between the first and second grids.

According to the producing method of the electron gun for the flat cathode-ray tube of the invention, the electron beam through hole of the second grid is previously separated from the reference position by a predetermined distance, and the first and second grids are positioned by the positioning means through the spacer therebetween. Therefore, it is possible to easily and precisely produce an electron gun which is formed such that the prefocus lens can correct the axis-separation of the electron gun.

Another producing method of an electron gun for a flat cathode-ray tube of the invention comprises the steps of: preparing a first grid having an electron beam through hole formed at a reference position and having a positioning hole formed at another reference position, and preparing a second grip having an electron beam through hole formed at a reference position and having a positioning hole formed at another reference position, and inserting positioning means in the positioning holes of the first and second grids for positioning the first and second grids such that an end surface having an electron beam through hole of the second grid is inclined with respect to the first grid in a state that a tapered spacer is interposed between the first and second grids.

According to the producing method of the electron gun for the flat cathode-ray tube of the invention, the first and second grids are positioned by the positioning means through the tapered spacer therebetween. Therefore, it is possible to easily and precisely produce an electron gun which is formed such that the prefocus lens can correct the axis-separation of the electron gun.

BRIEF DESCRIPTION OF THE DRAWINGS

FIG. 12 show steps for explaining one mode of a producing method of the electron gun for the flat cathode-ray tube of the invention, wherein

FIG. 16 show a step (3) for explaining another mode of the producing method of the electron gun for the flat cathode-ray tube of the invention, wherein

DETAILED DESCRIPTION OF THE PREFERRED EMBODIMENTS

Modes of a flat cathode-ray tube according to the present invention will be explained below.

Figure 1:
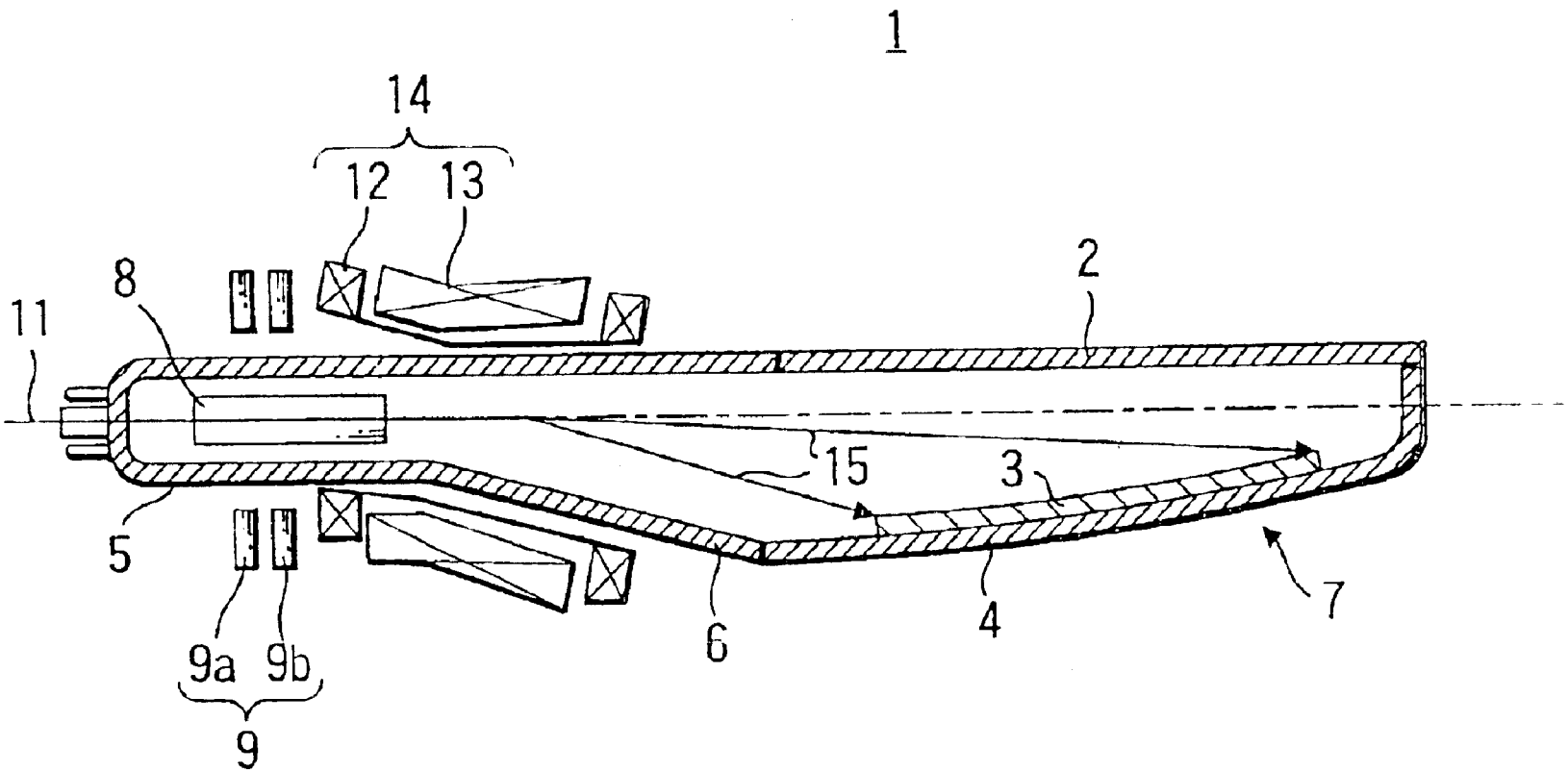
FIG. 1 (PRIOR ART)
FIG. 1 shows a structure of a conventional flat cathode-ray tube.
Figure 2:
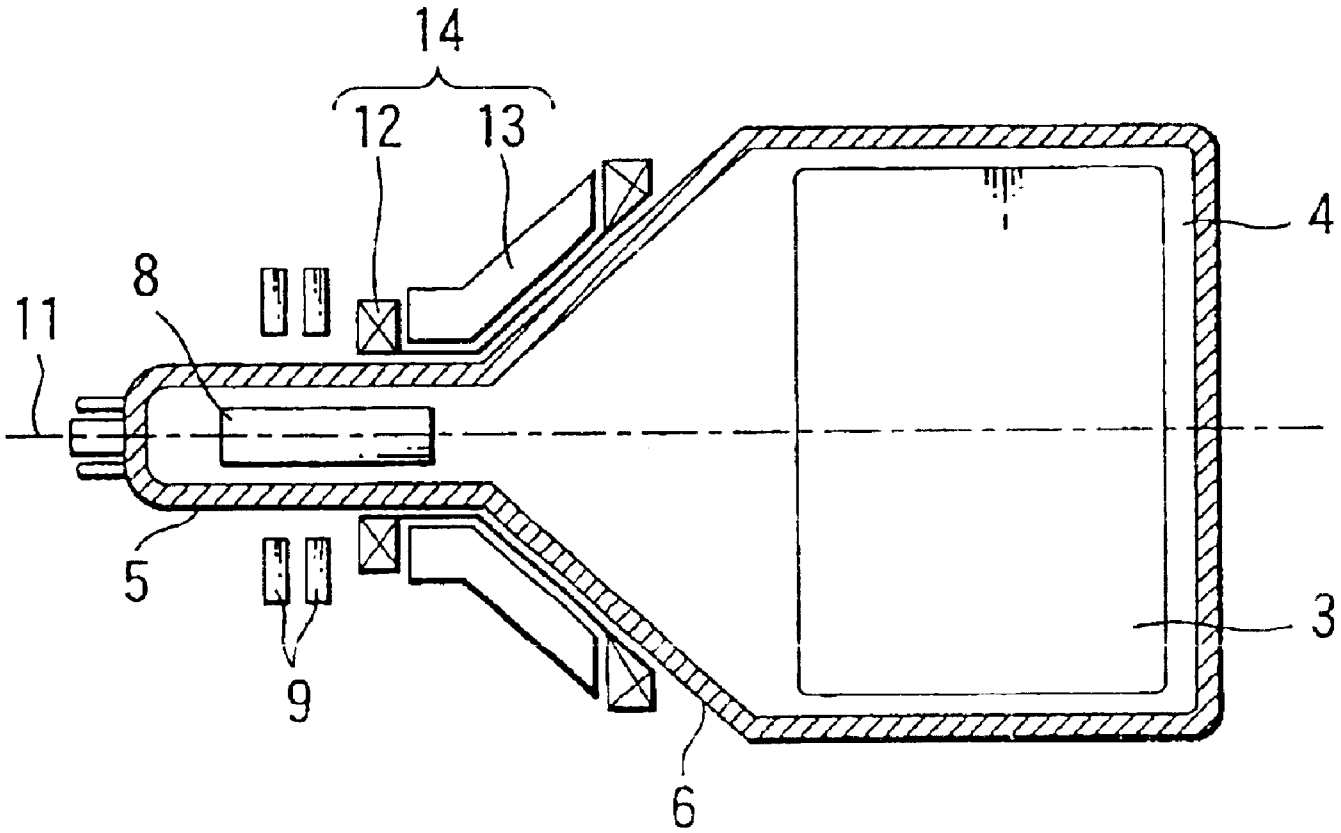
FIG. 2 (PRIOR ART)
FIG. 2 is a partially sectional plan view of the conventional flat cathode-ray tube.
Figure 3:
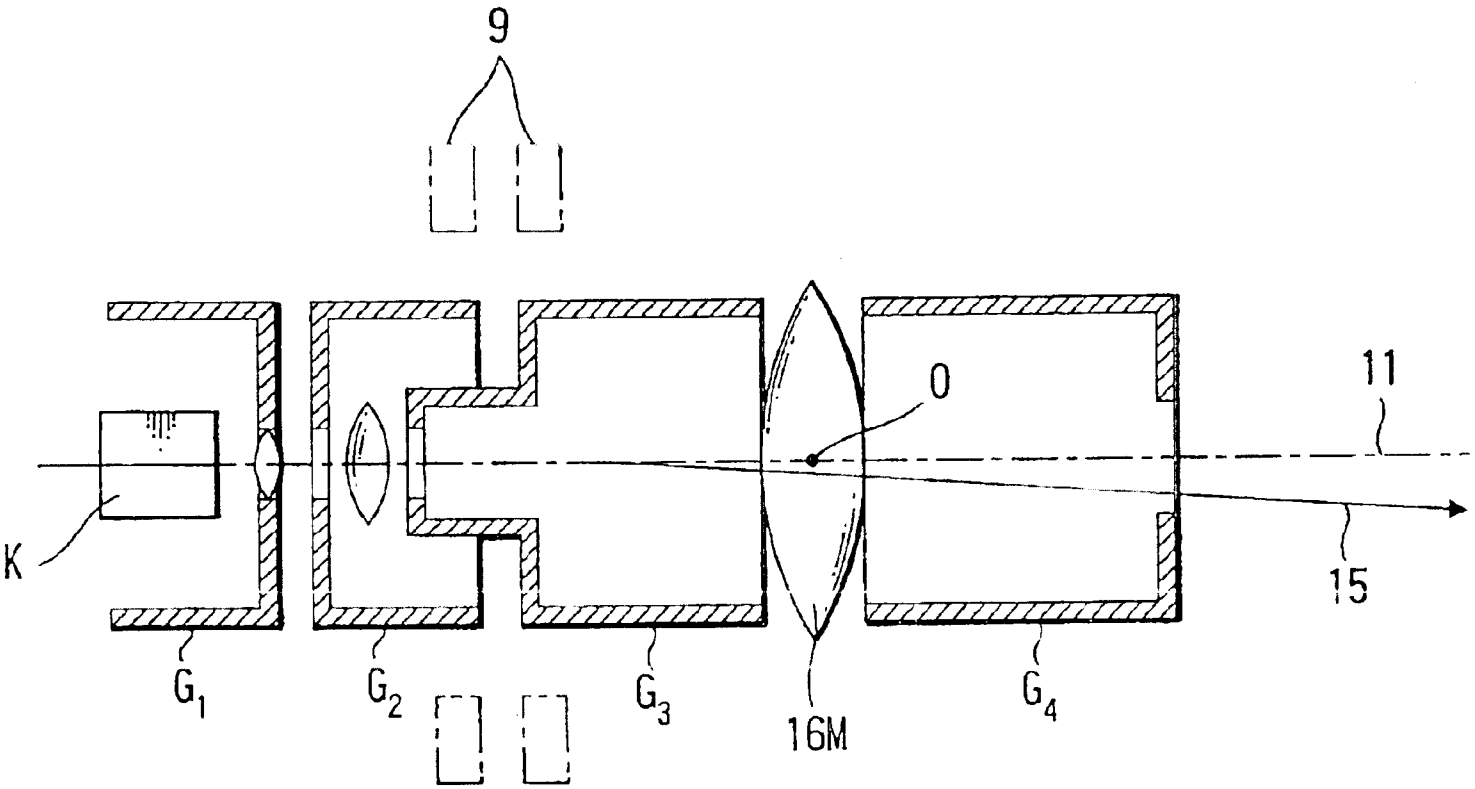
FIG. 3 (PRIOR ART)
FIG. 3 is an enlarged view showing an electron gun of the conventional flat cathode-ray tube.
Figure 4:
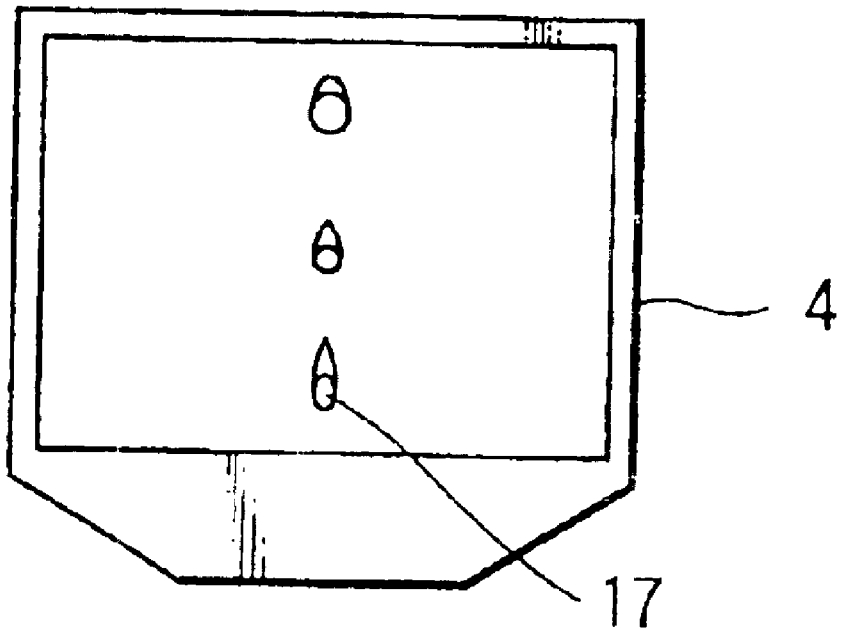
FIG. 4 (PRIOR ART)
FIG. 4 is a plan view of the conventional flat cathode-ray tube in which beam spots causing halation are shown.
Figure 5:
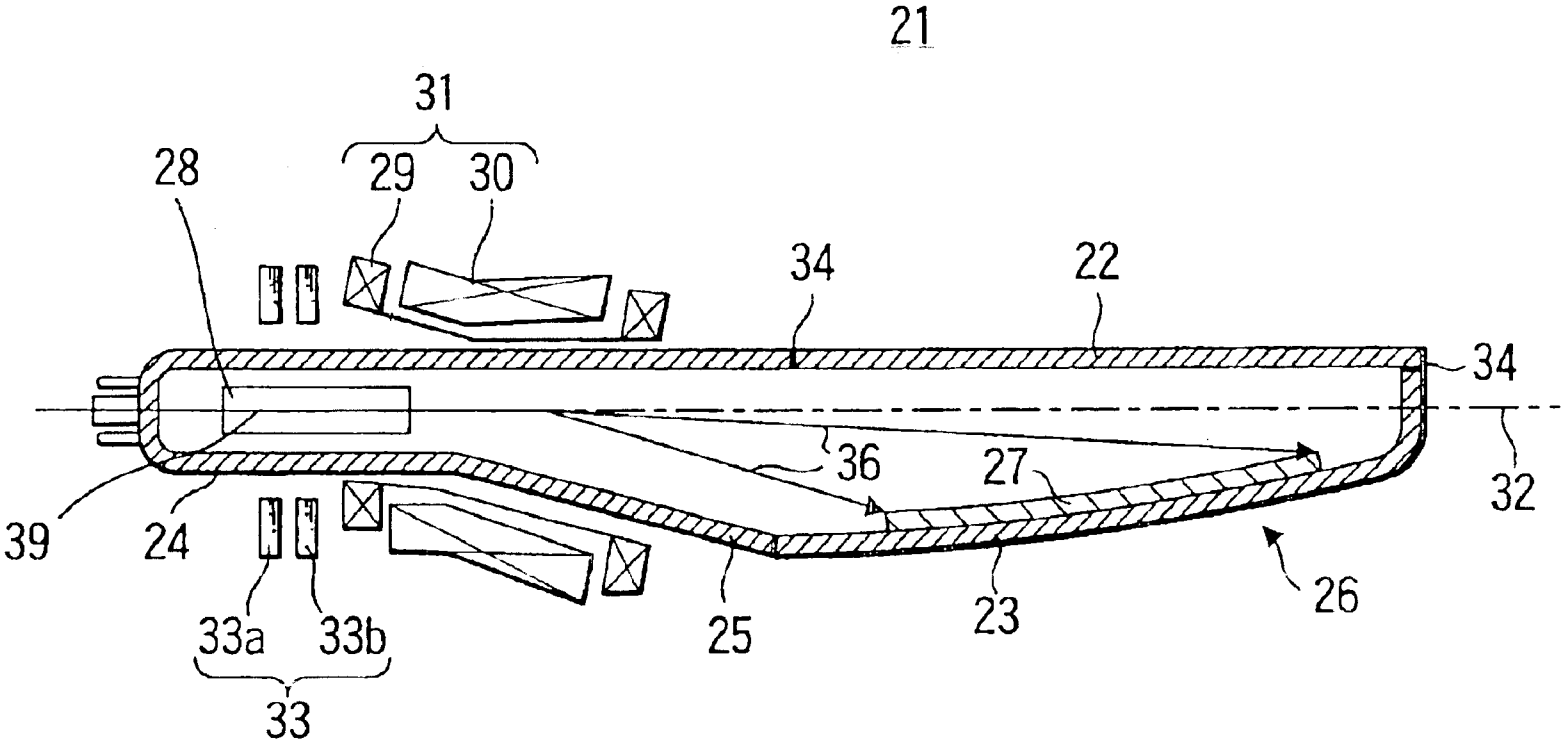
FIG. 5 shows a structure of one mode of a flat cathode-ray tube of the present invention.

FIG. 5 shows one mode of the flat cathode-ray tube of the invention.

The flat cathode-ray tube 21 of this mode includes a glass body 26 comprising a front panel 22, a screen panel 23 and a funnel 25 having a neck 24. These members constituting the glass body 26 are joined to one another through frit glasses. A fluorescent surface 27 is formed on an inner surface of the screen panel 23. An electron gun 28 of the present invention which will be described later is disposed in the neck 24 of the funnel 25 such that a center axis 39 coincides with a tube axis 32. Reference number 34 represents a frit joint portion. The glass body 26 is formed flatly such that the glass body 26 is laterally longer in the horizontal direction (vertical direction with respect to a paper sheet of FIG. 5) as a whole. The front panel 22 is formed into a transparent flat plate-like shape at a position opposed to the screen panel 23. The screen panel 23 is disposed diagonally or in parallel to a direction crossing the tube axis 32 diagonally. In FIG. 5, the screen panel 23 is disposed diagonally with respect to the tube axis 32.

A deflection yoke 31 having a horizontal deflection coil 29 and a vertical deflection coil 30 is disposed outside of the glass body 26 at a location thereof from the neck 24 to the funnel 25. A saddle type coil is used as the horizontal deflection coil 29 and a toroidal type coil is used as the vertical deflection coil 30. A combination of any of the saddle type coil and the toroidal type coil may be used.

Figure 6:
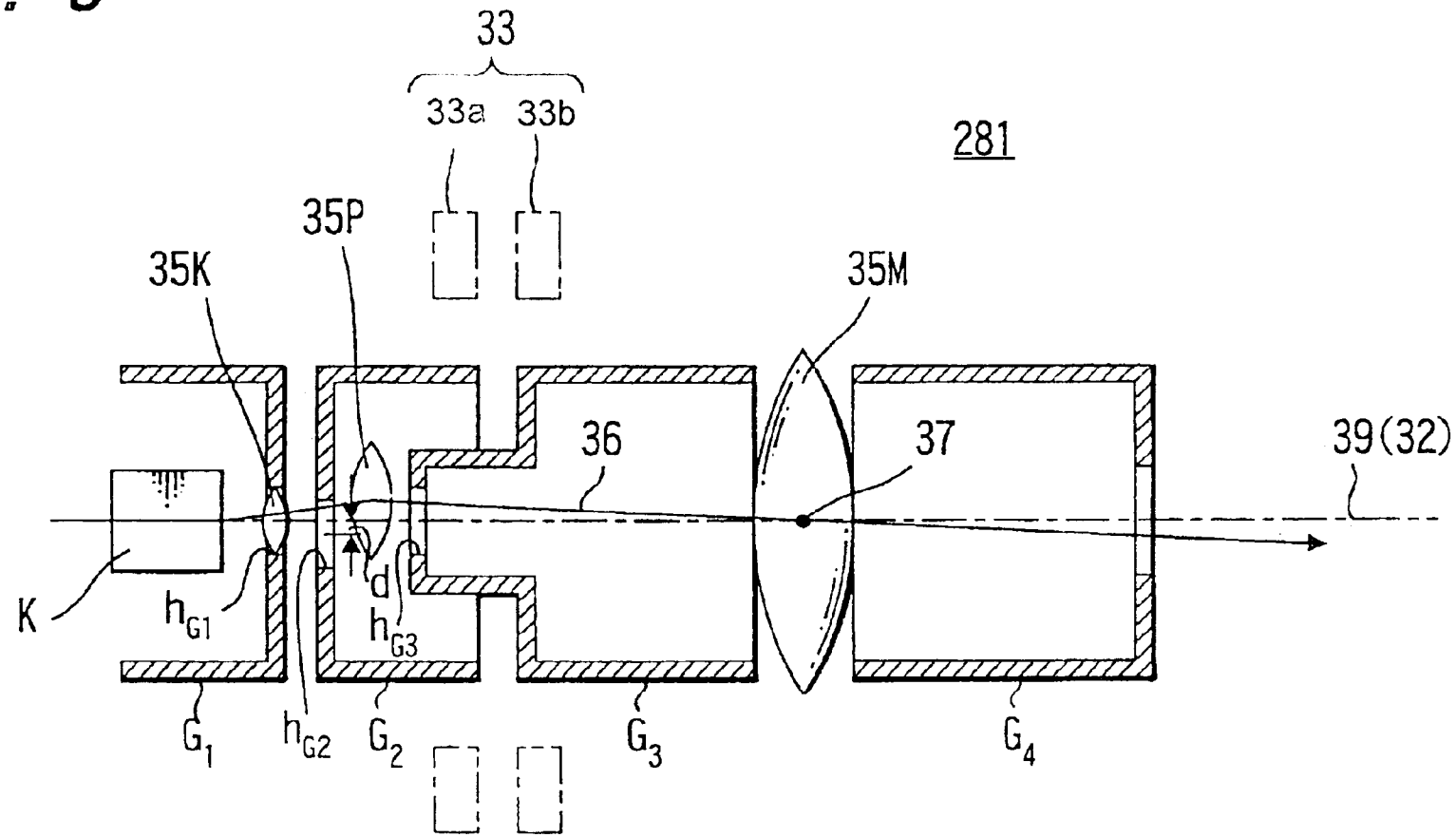
FIG. 6 is a perspective view showing an example of a centering magnet mounted to the flat cathode-ray tube.

A centering magnet 33 for adjusting an electron beam such that the electron beam scans an effective screen, i.e., a fluorescent surface 27 is disposed at an outer side of the neck 24 corresponding to a front portion of the deflection yoke 31. As shown in FIG. 6, the centering magnet 33 comprises two ring-like double-pole magnets (permanent magnets) 33*a* and 33*b*.

In this flat cathode-ray tube 21, a centering adjustment is carried out such that the screen comes to a proper position, i.e., to the fluorescent surface by means of the centering magnet 33. An electron beam 36 emitted from the electron gun 28 is deflected in the horizontal and vertical directions by the deflection yoke 31 and radiates onto the fluorescent surface 27 of the screen panel 23. The electron beam 36 is deflected symmetrically with respect to the deflection center in the horizontal direction, but is deflected asymmetrically in the vertical direction. A screen formed on the screen panel 23 can be seen from the side of the front panel 22 as described above. The flat cathode-ray tube in this case is a reflective type tube. In this flat cathode-ray tube 21, when the image on the screen panel 23 is seen from the side of the screen panel 23, the flat cathode-ray tube is a transparent type tube.

[First Example of Electron Gun]

FIG. 6 shows a mode of the electron gun 28 according to the present invention.

An electron gun 281 of this mode comprises a first grid $G_1$, a second grid $G_2$, a third grid $G_3$ and a fourth grid $G_4$. These grids $G_1$ to $G_4$ are arranged in this order along a direction of the tube axis 32. A cathode lens 35K is formed between a cathode K, the first grid $G_1$ and the second grid $G_2$. A prefocus lens 35P is formed between the second grid $G_2$ and the third grid $G_3$. A main lens 35M is formed between the third grid $G_3$ and the fourth grid $G_4$. In this example, the electron gun is formed as a so-called bipotential type electron gun.

In the flat cathode-ray tube using the centering magnet 33, the axis-separation is generated in the electron beam before the electron beam enters the main lens by the magnetic field of the centering magnet 33, and the coma aberration is generated. This coma aberration is proportional to an axis-separating amount of the electron beam before the electron beam enters the main lens.

In this mode, especially in order to separate the prefocus lens 35P from the tube axis 32, the second grid $G_2$ is separated from the tube axis 32 in one direction. In this mode, although the second grid $G_2$ is disposed coaxially with respect to the first grid $G_1$ and the third grid $G_3$, a center of a hole of an electron beam through hole $h_{G2}$ is separated from the tube axis 32 by a predetermined amount (distance), and this arrangement is called "axis-separation". An electron beam through hole $h_{G1}$ of the first grid $G_1$ and an electron beam through hole $h_{G3}$ of the third grid $G_3$ are formed such that centers of these holes exist on the tube axis 32. The electron beam through holes $h_{G1}$, $h_{G2}$ and $h_{G3}$ of the first to third grids $G_1$, $G_2$ and $G_3$ are formed are formed circularly in this mode.

Figure 7:
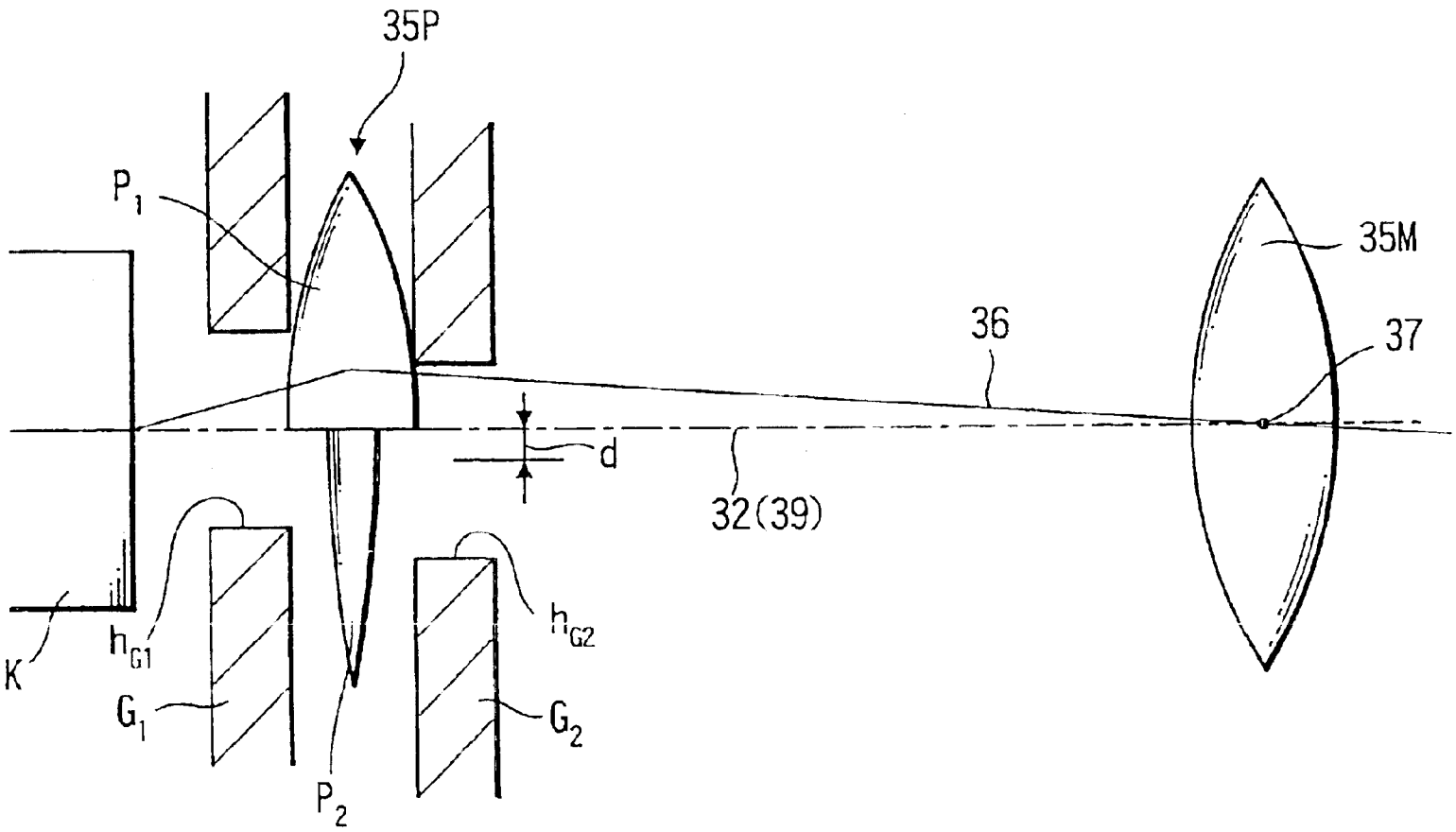
FIG. 7 shows a structure of one mode of an electron gun for the flat cathode-ray tube of the invention.

A direction to separate the second grid G2 is set to a direction in which the axis-separating amount of the electron beam becomes small. That is, as shown in FIG. 7, the electron beam before the beam enters the main lens is separated downward from the tube axis. Therefore, in the electron gun 281 of this mode, the second grid G2, i.e., its electron beam through hole hG2 is previously separated (deviated) in the same direction as the axis-separation direction (in a minus direction when the axis-separation direction of the electron beam is set in the minus direction) by a predetermined distance d which corresponds to an amount in which the axis-separating amount of the electron beam can be corrected.

Centers of the cathode lens 35K and the main lens 35M coincide with the center axis 39, and the prefocus lens 35P is separated from the center axis 39 by a predetermined distance.

Next, a working effect and an effect of the flat cathode-ray tube 21 having this electron gun 281 will be explained.

Figure 8:
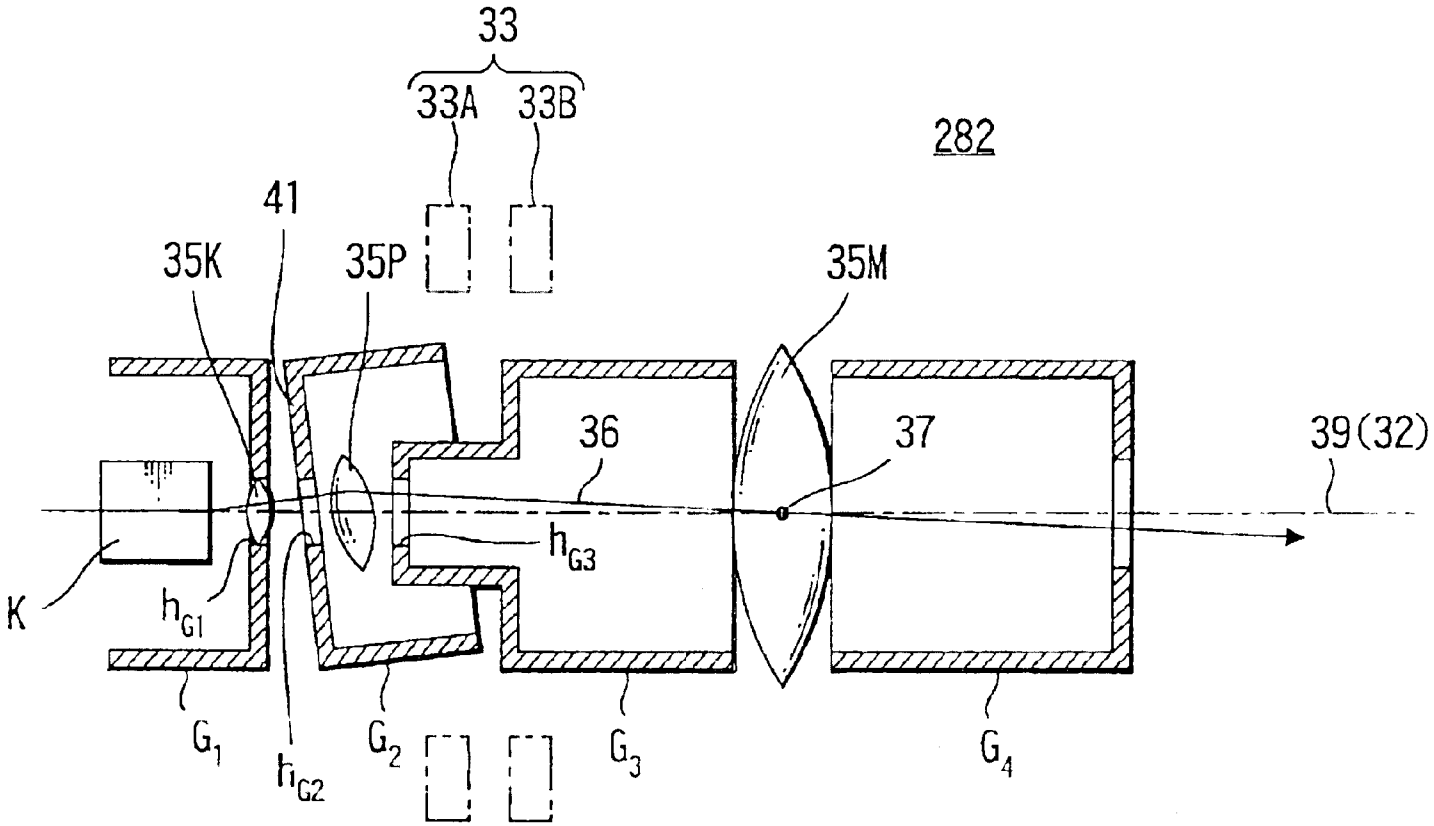
FIG. 8 is an explanatory view showing effect of a prefocus lens in the electron gun of the invention.

In the flat cathode-ray tube 21 of this mode, the axis of the electron beam through hole hG2 of the second grid G2 which contributes to the formation of the prefocus lens 35P is separated in the same direction as the axis-separation direction by a distance corresponding to the axis-separating amount of the electron beam. Therefore, as shown in FIG. 8, a lens effect of an upper side P1 of the prefocus lens 35P is strong, and the lens effect of a lower side P2 of the prefocus lens 35P is weak. To appearance, the axis prefocus lens 35P is separated. That is, since the electron beam through hole hG2 of the second grid G2 is deviated, an upper edge of the electron beam through hole hG2 approaches the tube axis 32 to strengthen the upper magnetic field strength, and a lower edge of the electron beam through hole hG2 is separated from the tube axis 32 to weaken the lower magnetic field strength. As a result, the lens effect of the upper side P1 is strong, and the lens effect of the lower side P2 is weak. For this reason, the electron beam 36 passing through the prefocus lens 35P moves (i.e., is bent) in an upward direction in which the magnetic field is strong and the electron beam 36 is refracted so as to return, and passes through the center 37 of the main lens 35M. With this design, it is possible to eliminate the halation caused by the coma aberration, and to enhance the resolution.

On the other hand, the electron beam 36 straightly running at the time of non-deflection radiates onto a screen inoperative portion except a frit junction portion 34 of the glass body 26. Therefore, the frit junction portion 34 is not deteriorated, the durability thereof becomes excellent, and the reliability of the flat cathode-ray tube is enhanced.

[Second Example of Electron Gun]

Figure 9:
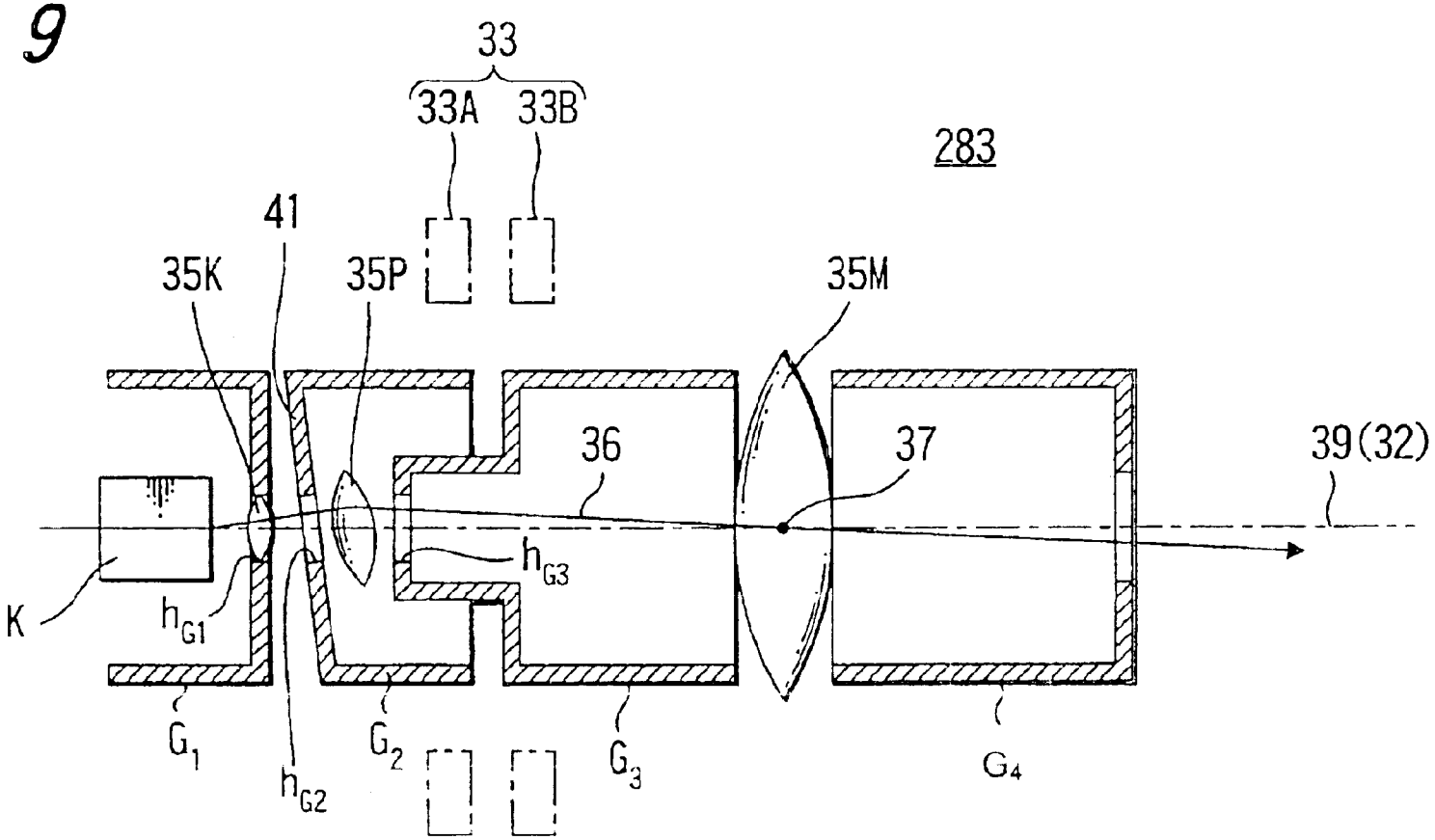
FIG. 9 shows a structure showing another mode of the electron gun for the flat cathode-ray tube of the invention.

FIG. 9 shows another mode of the electron gun 28 according to the present invention.

An electron gun 283 of this mode comprises a first grid G1, a second grid G2, a third grid G3 and a fourth grid G4. These grids G1 to G4 are arranged in this order along a direction of the tube axis 32. A cathode lens 35K is formed between a cathode K, the first grid G1 and the second grid G2. A prefocus lens 35P is formed between the second grid G2 and the third grid G3. A main lens 35M is formed between the third grid G3 and the fourth grid G4. In this example, the electron gun is formed as a so-called bipotential type electron gun.

In this mode, although the second grid $G_2$ which contributes to the formation of the prefocus lens 35P is disposed coaxially with respect to the first grid $G_1$ and the third grid $G_3$, an end surface 41 having the electron beam through hole $h_{G2}$ is disposed such that the end surface 41 is inclined with respect to the tube axis 32, so that the lens effect, therefore the magnetic field strength of the prefocus lens 35P is different between the upper side and the lower side of the lens 35P. The axis of the prefocus lens 35P is separated from the tube axis 32. FIG. 9 schematically shows that the prefocus lens 35P is inclined with respect to the tube axis 32. The electron beam through holes $h_{G1}$, $h_{G2}$ and $h_{G3}$ of the first to third grids $G_1$, $G_2$ and $G_3$ are formed are formed circularly in this mode. Therefore, the electron beam through hole $h_{G2}$ of the second grid $G_2$ is not a point in shape as viewed from the center axis 39 (an oval figure in this mode).

In this mode, the second grid $G_2$ is inclined such the upper end of the second grid $G_2$ approaches the first grid $G_1$ as shown in FIG. 9.

The end surface 41 having the electron beam through hole $h_{G2}$ of the second grid $G_2$ is inclined through a predetermined angle. Therefore, in the prefocus lens 35P, the upper side lens effect in FIG. 9 is strong and the lower side lens effect is weak. The electron beam 36 passing through the prefocus lens 35P moves upward above the tube axis 32 in FIG. 9, so that the electron beam 36 passes through the center of the main lens 35M. With this design, it is possible to eliminate the halation caused by the coma aberration, and to enhance the resolution.

Like the flat cathode-ray tube using the above-described electron gun 281, the electron beam 36 straightly running at the time of deflection radiates onto a screen inoperative portion except a frit junction portion 34 of the glass body 26. Therefore, the frit junction portion 34 is not deteriorated.

[Third Example of Electron Gun]

In the above example, the second grid $G_2$ itself is inclined. Alternatively, an electron gun 283 may be formed such that only the end surface 41 having the electron beam through hole $h_{G2}$ is inclined without inclining the second grid $G_2$ itself. The electron beam through hole $h_{G2}$ in this case is circular in shape on the end surface 41 and thus, the electron beam through hole $h_{G2}$ is an oval figure in shape as viewed from the tube axis in its inclined state. In this electron gun 283 having this structure also, the same working effect and effect as those shown in FIG. 9 can be obtained.

Next, a producing method of the electron gun according to the previous mode.

Figure 12A:
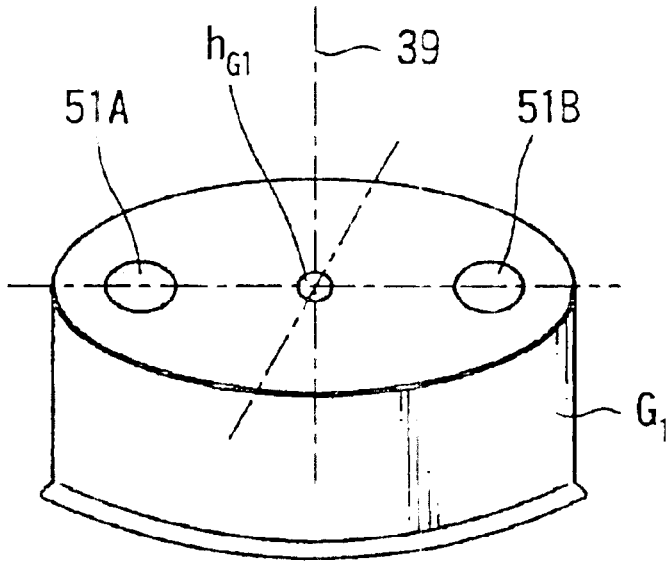
FIG. 12A is a perspective view of a first grid and FIG. 12B is a perspective view of a second grid.
Figure 12B:
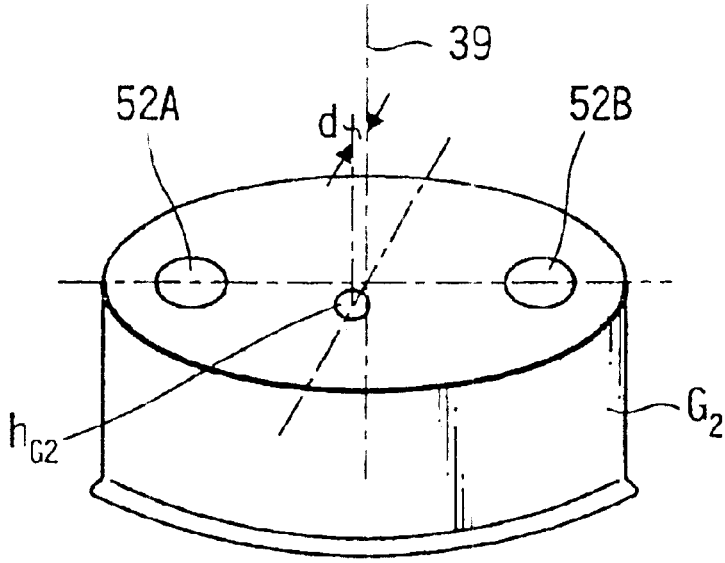

FIGS. 12 to 15 show a mode of the producing method of the above-described electron gun 281. In this mode, as shown in FIG. 12, the first grid $G_1$ (FIG. 12A) and the second grid $G_2$ (FIG. 12B) are prepared first. In the first grid $G_1$, its electron beam through hole $h_{G1}$ having a hole center which coincides with one reference position corresponding to a position on the center axis 39, and the first grid $G_1$ is formed with a pair of so-called index holes 51 (51A, 51B) at symmetrical positions about the electron beam through hole $h_{G1}$. The index holes 51 are used for positioning at the time of assembling. The second grid $G_2$ is formed with the electron beam through hole $h_{G2}$ having a hole center at a position separated from the center axis 39 by a predetermined distance d. The second grid $G_2$ is also formed with a pair of index holes 52 (52A, 52B) at other reference positions like the first grid $G_1$.

Figure 13:
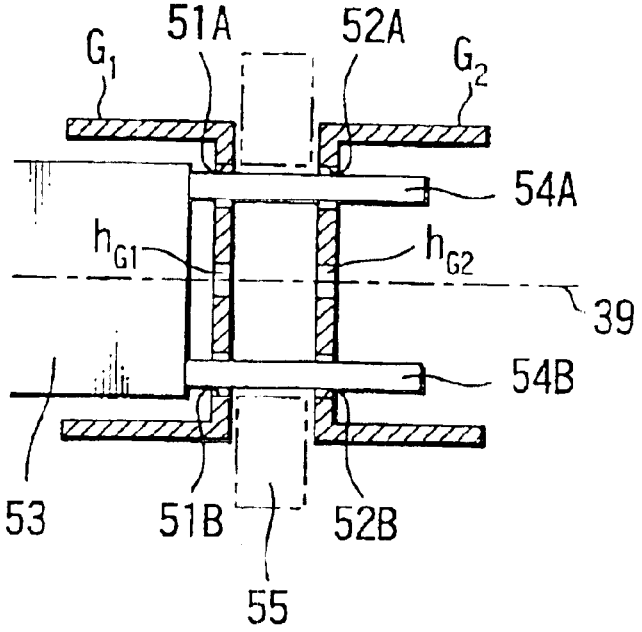
FIG. 13 shows a step (2) for explaining one mode of the producing method of the electron gun for the flat cathode-ray tube of the invention.
Figure 14:
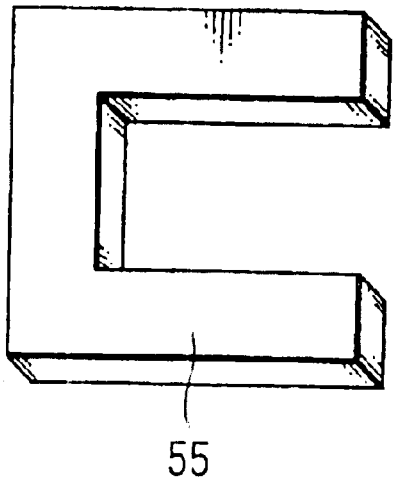
FIG. 14 is a perspective view showing an example of a spacer used in FIG. 13.
Figure 15:
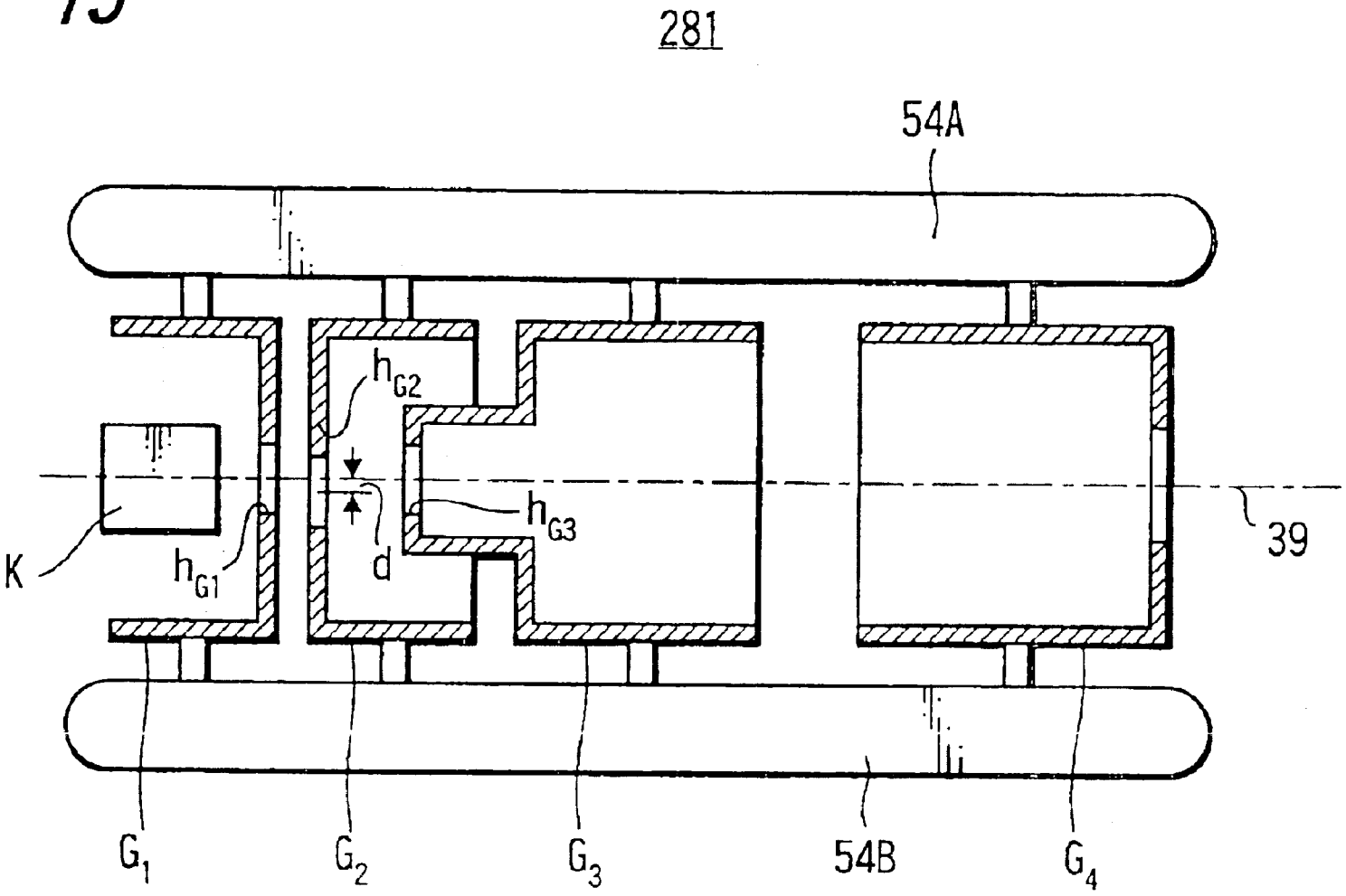
FIG. 15 shows a step (3) for explaining one mode of the producing method of the electron gun for the flat cathode-ray tube of the invention.

Next, as shown in FIG. 13, the first grid $G_1$ is positioned by inserting positioning means, e.g., a pair of index pins 54 (54A, 54B) embedded in a pad 53 into index holes 51 (51A, 51B) of the first grid $G_1$. Then, the second grid $G_2$ is positioned on the first grid $G_1$ by inserting index pins 54 (54A, 54B) into the index holes 52 (52A, 52B) through a U-shaped spacer 55 (see FIG. 14) which defines a distance between first grid $G_1$ and the second grid $G_2$.

Further, the third grid $G_3$ and the fourth grid $G_4$ are positioned and then, a pair of bead glasses 54 (54A, 54B) are pushed against the first grid $G_1$ to the fourth grid $G_4$, thereby carrying out a beading processing. Thereafter, the cathode K is disposed in the first grid $G_1$ to obtain the final electron gun 281 shown in FIG. 15.

FIGS. 16 to 19 show a mode of a producing method of the above-described electron gun 282.

Figure 16A:
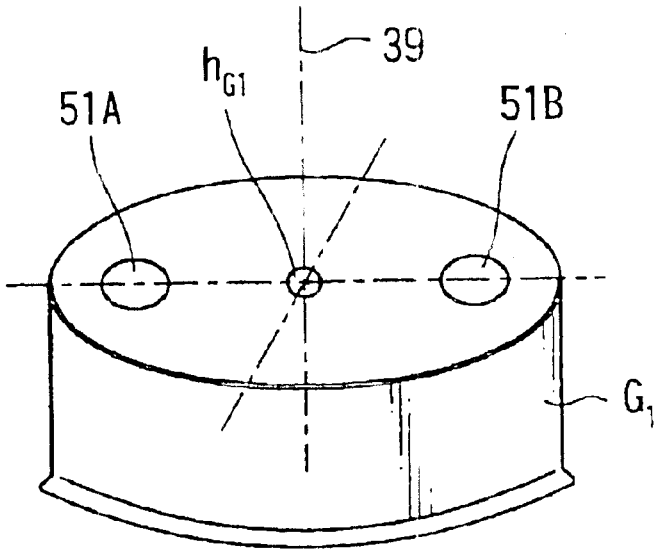
FIG. 16A is a perspective view of a first grid and FIG. 16B is a perspective view of a second grid.
Figure 16B:
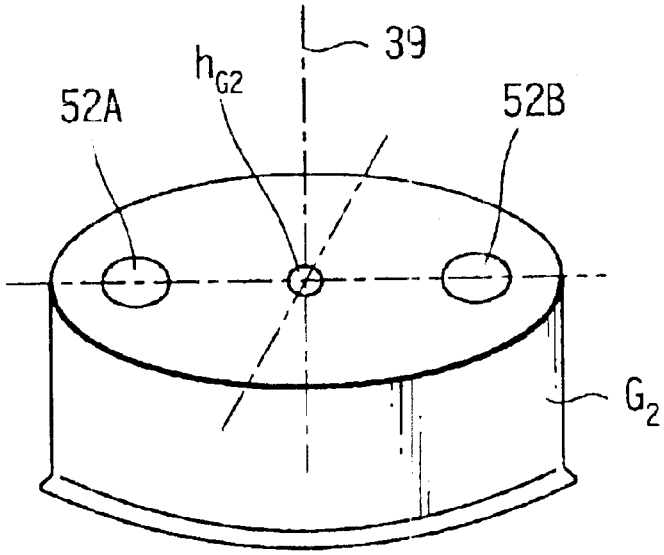

In this mode, first, as shown in FIG. 16, the first grid G1 (FIG. 16A) and the second grid G2 (FIG. 16B) are prepared first. The first grid G1 is formed with the electron beam through hole hG1 having a hole center which coincides with one reference position corresponding to a position on the center axis 39, and the first grid G1 is also formed with a pair of index holes 51 (51A, 51B) at other reference positions. The second grid G2 is formed with the electron beam through hole hG2 having a hole center at a position corresponding to one reference position corresponding to a position on the center axis 39. The second grid G2 is also formed with a pair of index holes 52 (52A, 52B) at other reference positions.

Figure 17:
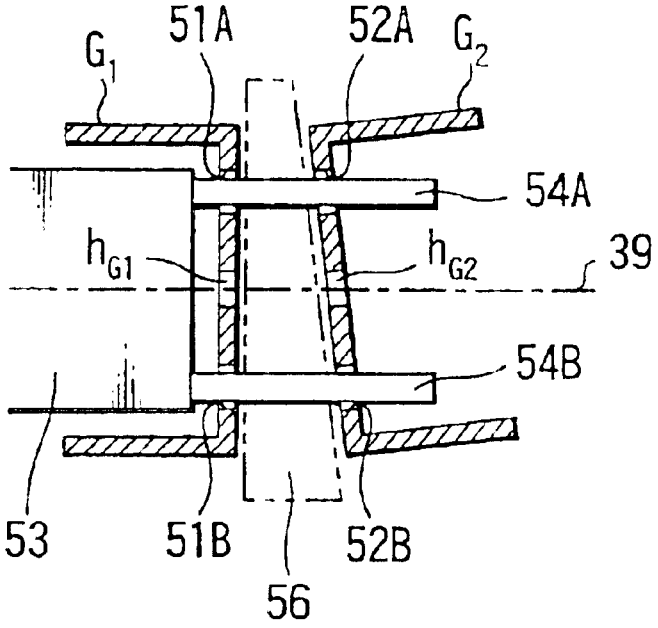
FIG. 17 shows a step (2) for explaining another mode of the producing method of the electron gun for the flat cathode-ray tube of the invention.
Figure 18:
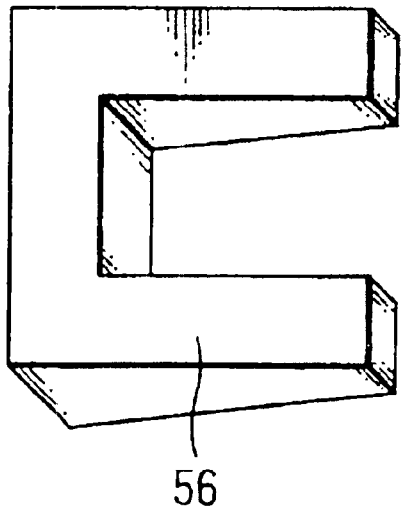
FIG. 18 is a perspective view showing an example of the spacer used in FIG. 17.
Figure 19:
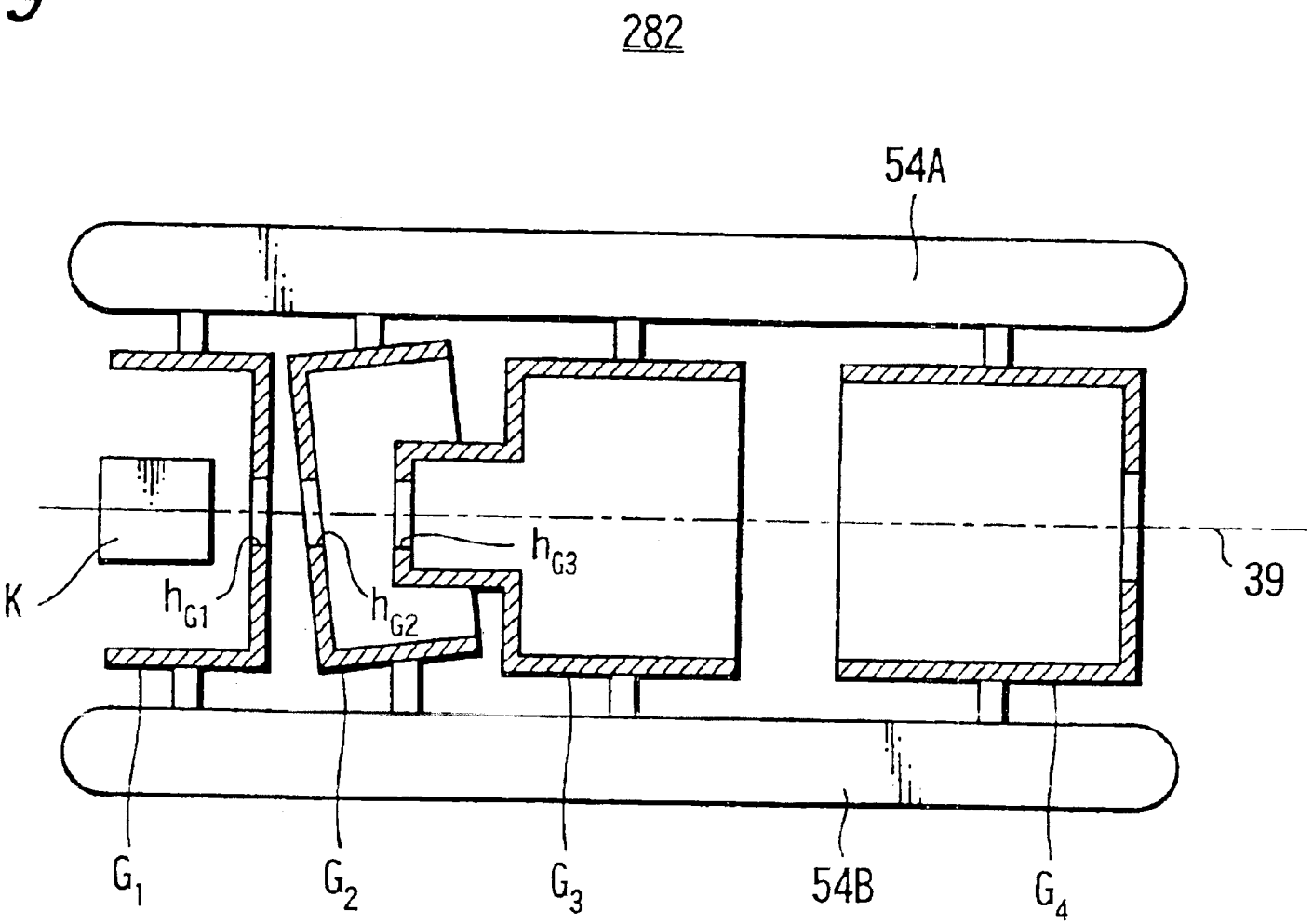
FIG. 19 shows a step (3) for explaining another mode of the producing method of the electron gun for the flat cathode-ray tube of the invention.

Then, as shown in FIG. 17, like the above mode, the first grid $G_1$ is positioned by inserting a pair of index pins 54 (54A, 54B) of a pad 53 into index holes 51 (51A, 51B) of the first grid $G_1$. Then, the second grid $G_2$ is positioned on the first grid $G_1$ by inserting index pins 54 (54A, 54B) into the pair of index holes 52 (52A, 52B) through a tapered spacer 56 (this is a spacer for defining the distance between the first grid $G_1$ and the second grid $G_2$ of course, and the spacer is formed into U-shape as viewed from its upper surface as shown in FIG. 18).

Further, the third grid G3 and the fourth grid G4 are positioned and then, a pair of bead glasses 55 (55A, 55B) are pushed against the first grid G1 to the fourth grid G4, thereby carrying out a beading processing. Thereafter, the cathode K is disposed in the first grid G1 to obtain the final electron gun 282 shown in FIG. 19.

Figure 10:
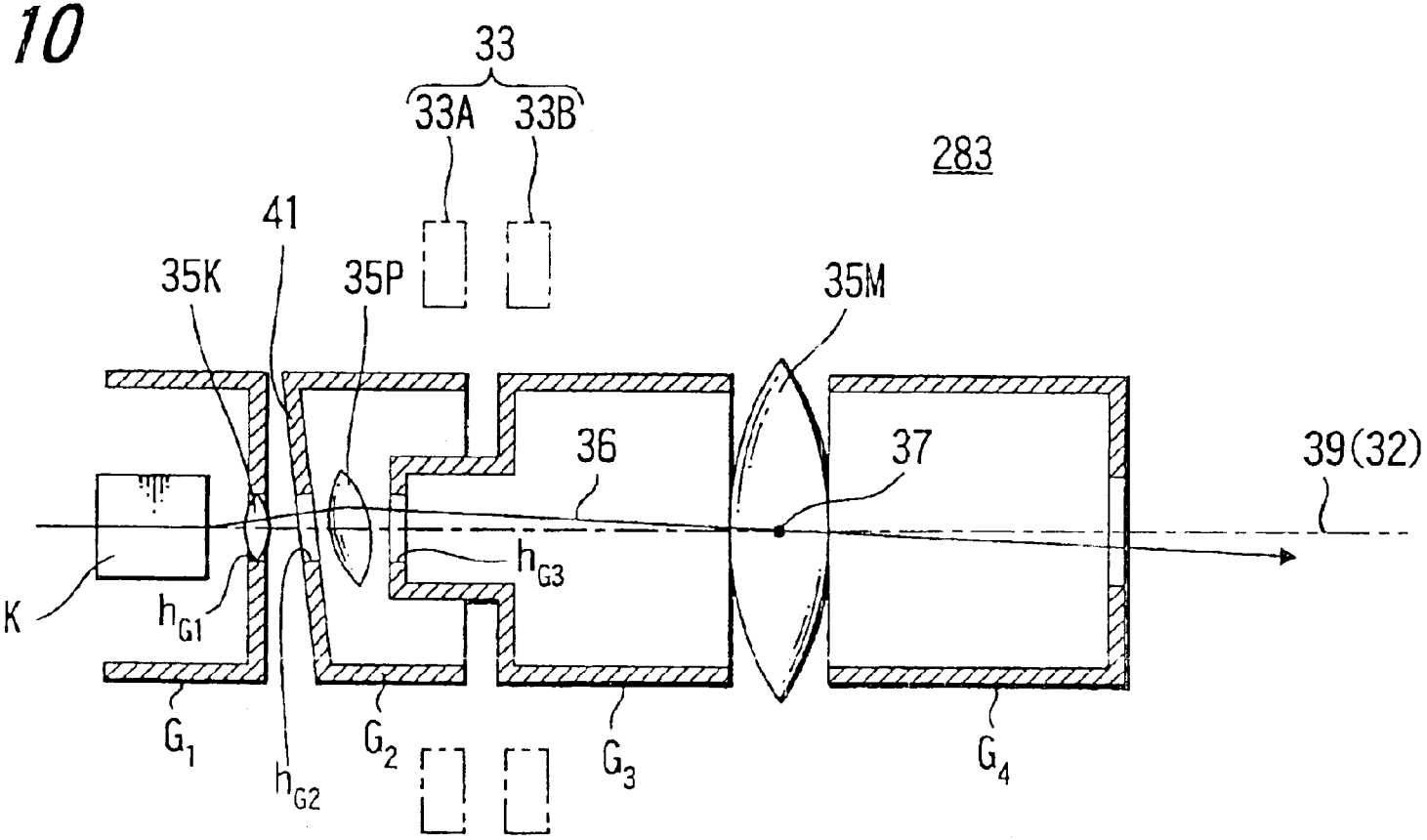
FIG. 10 shows a structure showing another mode of the electron gun for the flat cathode-ray tube of the invention.

The producing method of the electron gun 283 in FIG. 10 is produced by the same producing method with the electron gun 282.

According to the producing method of the above-described electron guns 281, 282 and 283, when the method is used for the flat cathode-ray tube, it is possible to easily produce an electron gun capable of correcting an effect of a magnetic field caused by the centering magnet 33, i.e., an electron gun in which an electron beam passing through the prefocus lens 35P passes the center of the main lens 35M to obtain an excellent beam spot.

Figure 11:
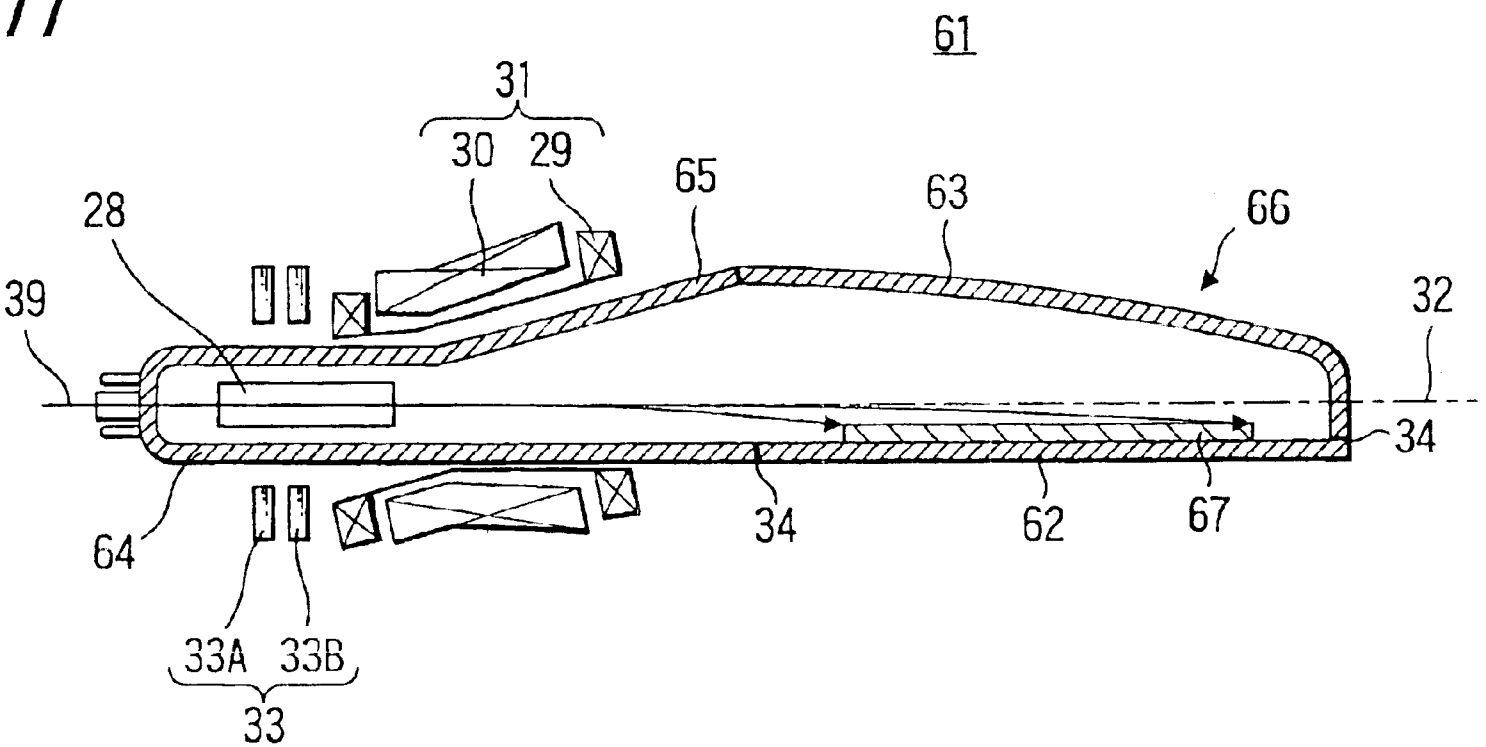
FIG. 11 shows a structure of another mode of the flat cathode-ray tube of the invention.

Although the screen panel 26 is inclined with respect to the tube axis 32 through a small angle in the flat cathode-ray tube 21 shown in FIG. 5, the screen panel may be in parallel to the tube axis as shown in FIG. 11.

A flat cathode-ray tube 61 according to the present mode shown in FIG. 11 includes a glass tube body 66. The glass tube body 66 comprises a screen panel 62 which is in parallel to the tube axis 32, a back panel 63, and a funnel 65 having a neck 64, and these constituent members of the glass tube body 66 are joined to one another through frit glasses. A fluorescent surface 67 is formed on an inner surface of the screen panel 62. The electron gun 28 of the present invention is disposed in the neck 64 of the funnel 65 such that the center axis 39 coincides with the tube axis 32. In this flat cathode-ray tube 61, the screen panel 62 is disposed in parallel to the tube axis 32. Reference number 34 represents a frit junction. The glass body 66 is formed flatly such that the glass body 66 is laterally longer in the horizontal direction as a whole. The screen panel 62 is formed into a transparent flat-plate like shape and is disposed in parallel to the tube axis 32.

The above-described electron guns 281, 282, 283 and the like respectively shown in FIGS. 7, 9 and 10 can be used as the electron gun 28.

A deflection yoke 31 having a horizontal deflection coil 29 and a vertical deflection coil 30 is disposed outside of the glass body 66 at a location thereof from the neck 64 to the funnel 65 like the previous mode. A centering magnet 33 is disposed at an outside position of the neck 64 corresponding to the front portion of the deflection yoke 31.

In this flat cathode-ray tube 61, an electron beam 36 emitted from the electron gun 28 is deflected horizontally and vertically by the deflection yoke 31, and radiates onto the fluorescent surface 67 of the screen panel 62. A screen formed on the screen panel 62 can be seen from the side of the screen panel 62. The flat cathode-ray tube 61 in this case is a transparent type tube.

In this flat cathode-ray tube 61 of the present mode also, like the previous mode, an axis of the electron beam is separated by an effect of the magnetic field of the centering magnet 33, but since the axis of the prefocus lens 35P of the electron gun 28 is separated, the axis-separation of the electron beam caused by the centering magnet 33 is offset, the electron beam passes through the center of the main lens 35M, the halation caused by the coma aberration is eliminated, and the resolution can be enhanced.

[Embodiment 1 of Flat Cathode-ray Tube]

Next, the flat cathode-ray tube of the above-described mode, i.e., the flat cathode-ray tube 21 having the electron gun 281 was actually produced, and a relation between the axis-separating amount of the electron beam caused by the magnetic field of the centering magnet 33 and the axis-separation of the prefocus lens in the electron gun was studied. A result thereof will be explained.

Figure 20:
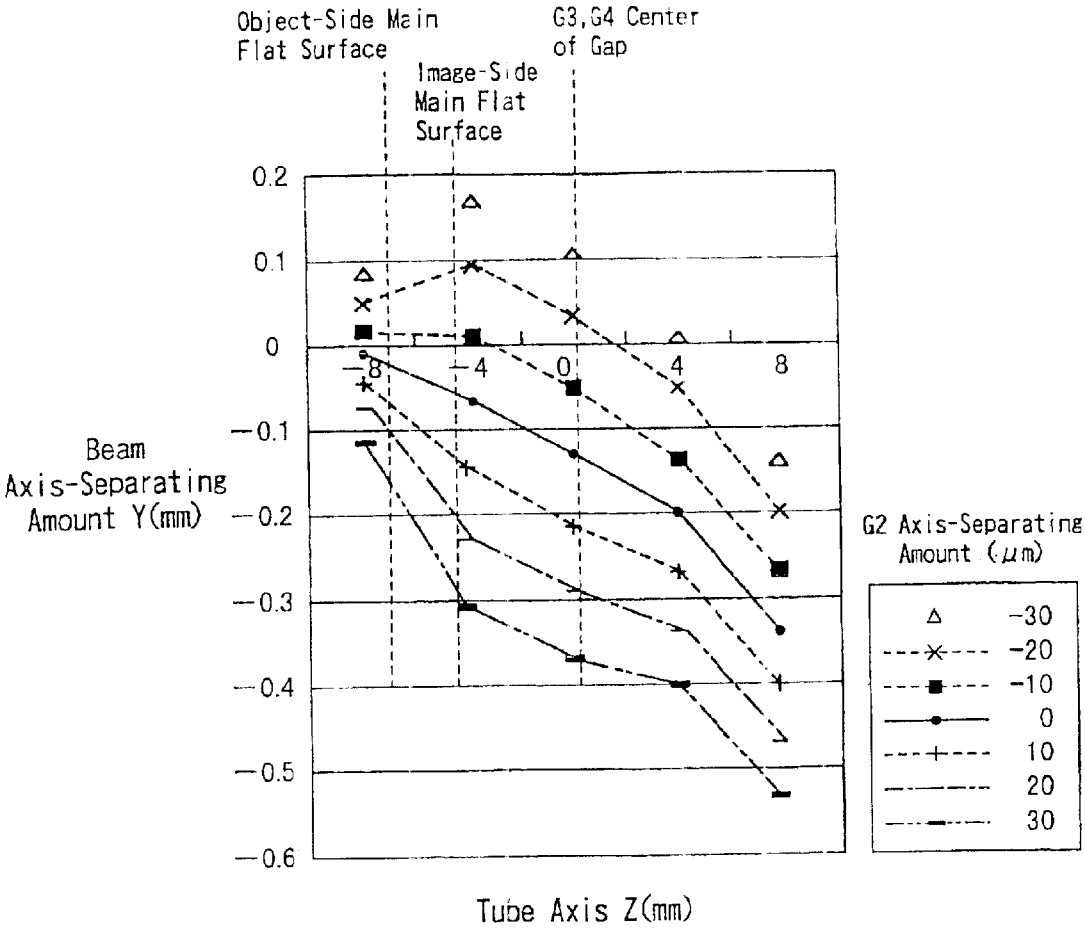
FIG. 20 is a graph showing a relation between a distance Z in an axial direction of the tube and an axis-separating amount of the electron beam using the axis-separating amount of the electron beam through hole $h_{G2}$ of the second grid $G_2$ as a parameter.

FIG. 20 is a graph showing a relation between the axis-separating amount (deviation amount) of the center of the second grid $G_2$ and thus, of the electron beam through hole $h_{G2}$, and the axis-separating amount of the electron beam. Here, a tube axis Z indicates a center of a gap between the third grid $G_3$ and the fourth grid $G_4$ forming the main lens 35M, an object-side main flat surface indicates a center of the second grid $G_2$, and an image-side main flat surface indicates a center of the third grid $G_3$.

According to this result, when a center of the electron beam through hole $h_{G2}$ of the second grid $G_2$ is separated (deviated) as the axis-separating amount d in FIG. 7 from the tube axis 32 by an amount between −10 μm to −20 μm, e.g., about −15 μm, it is found that the axis-separating amount of the beam in the main lens 35M becomes minimum, and the axis-separation of the electron beam caused by the magnetic field of the centering magnet 33 is offset.

As one method for quantitatively showing an amount of coma aberration by the same electron gun, there is an SP (spot) moving amount. The SP moving amount is shown with an amount of a beam spot center core moving on the screen panel when the strength of the main focus lens of the electron gun is changed. When the SP moving amount is zero, the beam center passes through the center of the main focus lens and thus, the coma aberration is zero.

Figure 21:
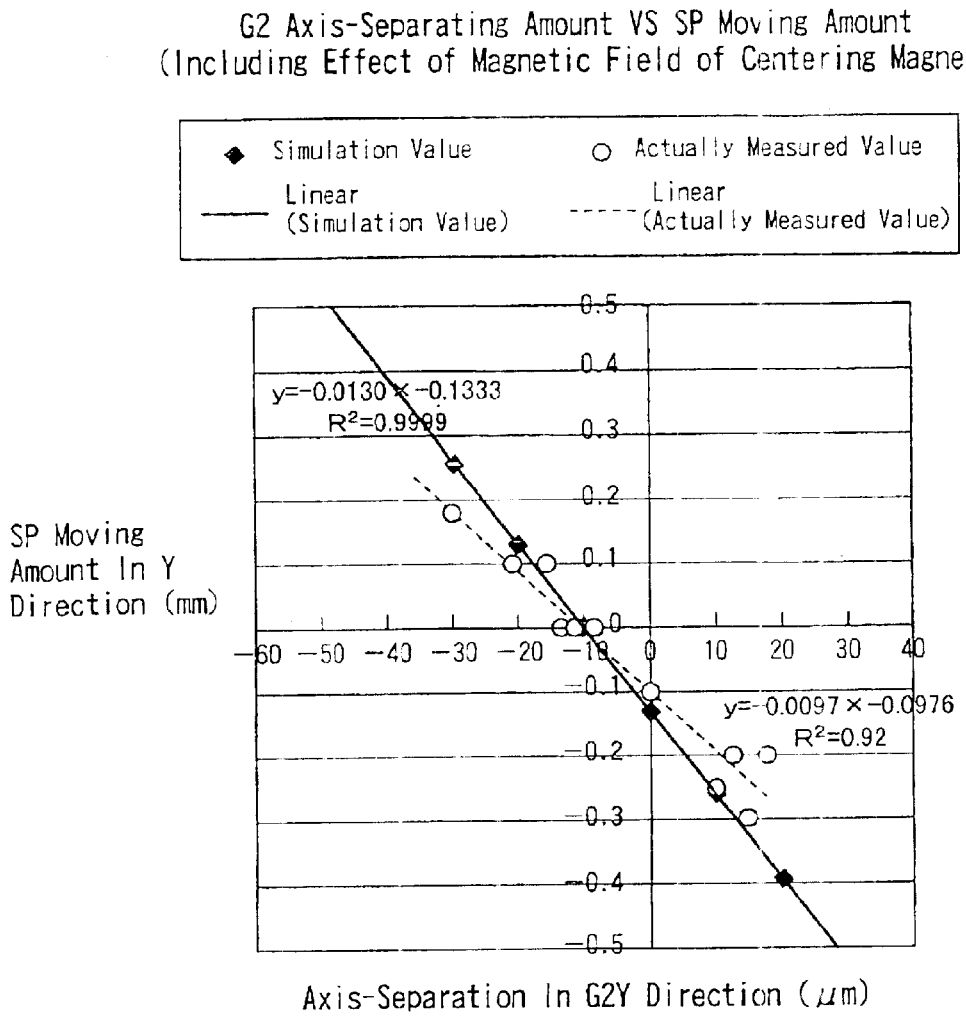
FIG. 21 is a graph showing a relation between an SP moving amount and the axis-separating amount of the electron beam through hole $h_{G2}$ of the second grid $G_2$ using a simulation result and actually measured data.
Figure 22:
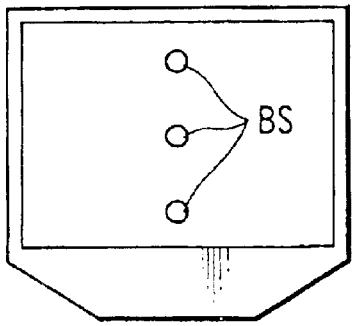
FIG. 22 is a plan view of the flat cathode-ray tube of the invention in which beam spots having no halation are shown.

FIG. 21 is a graph showing a relation between the SP moving amount and the axis-separating amount (deviation amount) of the center of the electron beam through hole $h_{G2}$ of the second grid $G_2$ using a simulation result and the actually measured data.

It can be found from FIG. 21 that when the axis of the second grid $G_2$ is separated, i.e., when the center of the electron beam through hole $h_{G2}$ is deviated from the tube axis 32 by an amount of −15 μm (15 μm (therefore, from 0 to −30 μm, but 0 is not includes), the SP moving amount is reduced, and when the center is deviated by an amount of about from −10 μm to −20 μm, more preferably, from −10 μm to −15 μm, the SP moving amount becomes minimum. It was confirmed that in the beam spot when the center of the electron beam through hole $h_{G2}$ of the second grid $G_2$ was deviated from the tube axis 32 by an amount from 0 to −15 μm (0 is not included), more preferably by an amount from −10 μm to −20 μm, and further preferably by an amount from −10 μm to −15 μm, beam spots BS having halation shown in FIG. 18 were obtained at a center, an upper end and a lower end of the screen panel. In a position where the center of the electron beam through hole $h_{G2}$ of the second grid $G_2$ was separated from the tube axis 32 by an amount of −15 μm to an amount from −10 μm to −20 μm, the simulation result and the actually measured data coincided with each other substantially.

According to FIG. 21, when the axis-separating amount is in a range of −8 μm to −30 μm, the SP moving amount is stable in a range of 0.0 to 0.19. Whereas, when the axis-separating amount is in a range of +10 μm to +18 μm, the SP moving amount is dispersed in a range of −0.2 to −0.3, and variation of the SP moving amount is great. If the variation in the SP moving amount is great, when the focus is adjusted, the variation differs in every screen, which is inconvenient.

[Embodiment 2 of Flat Cathode-ray Tube]

The present inventors repeated an experiment of the flat cathode-ray tube 21 having the above-described electron gun 281 and studied the optimization of the axis-separating amount. A result thereof will be explained.

Table 1 shows a halation width of the beam spot, the SP moving amount, and horizontal (H) and vertical (V) limit resolution when the axis-separating amount (=d) of the electron beam through hole $h_{G2}$ of the second grid $G_2$ is +15 μm and −15 μm, respectively.

TABLE 1

| Axis-separating amount of beam hole of $G_2$ (μm) | Limit resolution (TV) average (X) Horizontal (H) | Vertical (V) | Halation width (mm) | SP moving amount (mm) X | Y |
|---|---|---|---|---|---|
| +15 | ≧520 | ≧300 | 0.8 | 0 | −0.20 |
| −15 | ≧580 | ≧300 | 0 | 0 | 0.04 |

According to Table 1, it can be found that when the axis-separating amount is −15 μm, the halation width and the SP moving amount are smaller than those when the axis-separating amount is +15 μm, and the horizontal resolution is enhanced. When the axis-separating amount is −15 μm, it can be found that the halation width becomes "0", and the variation in the SP moving amount is small and stable.

Figure 23:
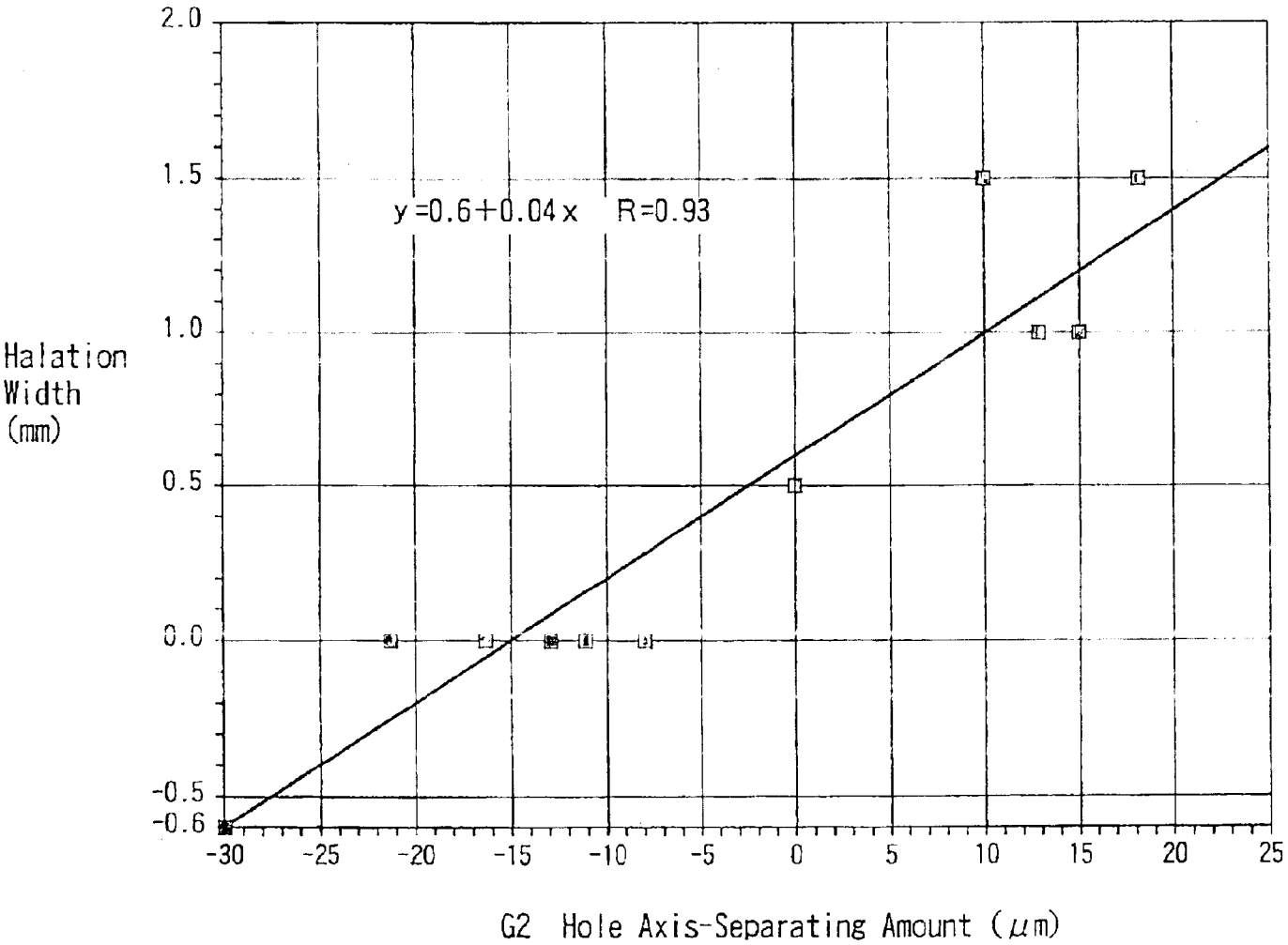
FIG. 23 is a graph showing a relation between a halation width and the axis-separating amount of the electron beam through hole $h_{G2}$ of the second grid $G_2$.

FIG. 23 is a graph showing a relation between the axis-separating amount of the electron beam through hole $h_{G2}$ of the second grid $G_2$ and the halation width of the beam spot.

According to FIG. 23, it can be found that when the axis-separating amount is in a range of −8 μm to −21 μm, the halation width is concentrated on "0.0", and when the axis-separating amount is −30 μm, the halation width is as small as −0.6 mm. On the other hand, when the axis-separating amount is in a range of 0 μm to +18 μm, it is found that the halation width is varied in a range of 0.5 to 1.5.

Figure 24:
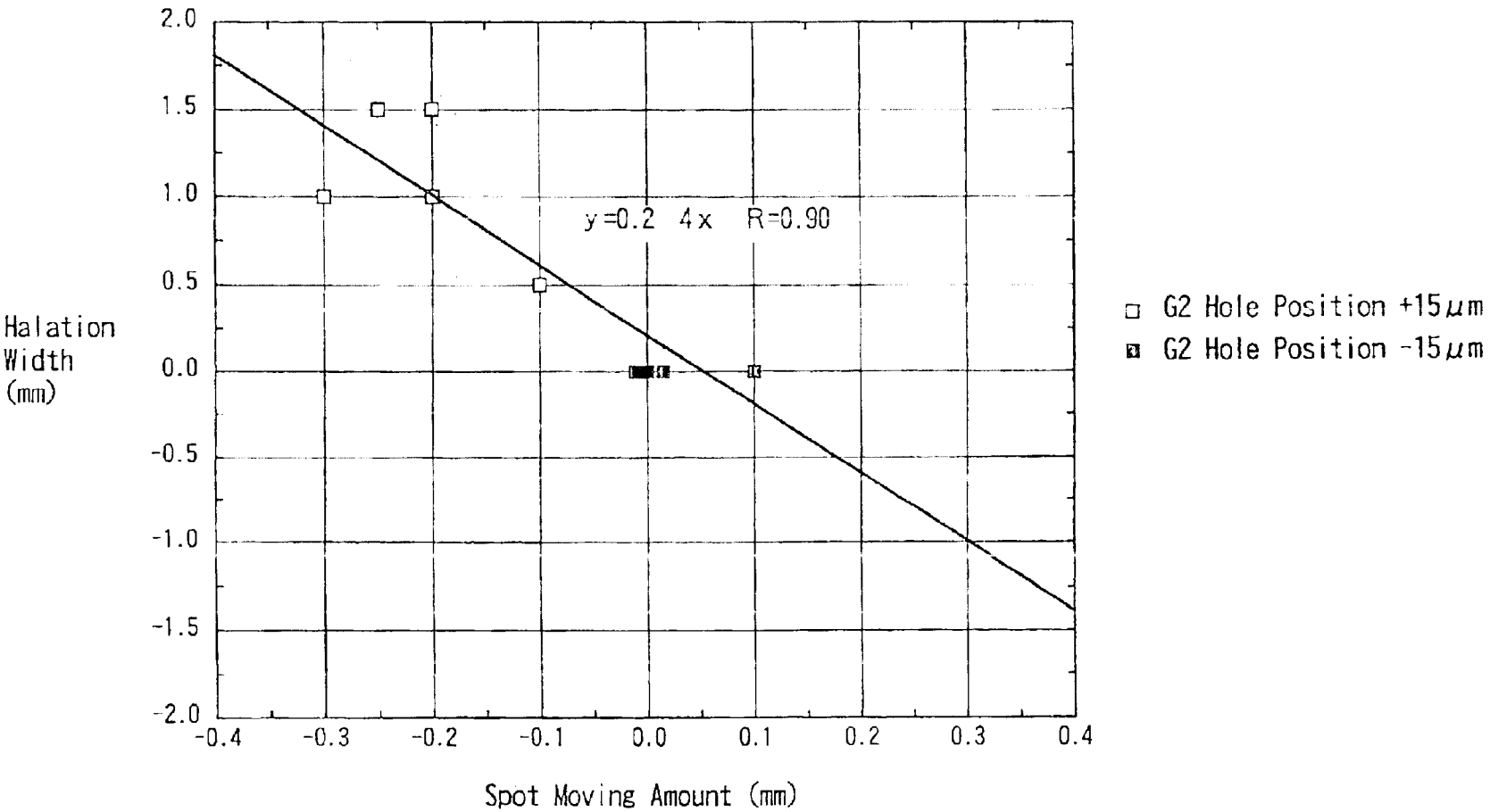
FIG. 24 is a graph showing a relation between the SP moving amount and the halation width using the axis-separating amount of the electron beam through hole $h_{G2}$ of the second grid $G_2$ as a parameter.

FIG. 24 is a graph showing a relation between the SP moving amount and the halation width of the beam spot when the axis-separating amount of the electron beam through hole $h_{G2}$ of the second grid $G_2$ is in a range of −15 μm to +15 μm.

According to FIG. 24, it is found that when the axis-separating amount is −15 μm, the SP moving amount is as small as 0 to 0.1 and stable, and the halation width is 0.0 and stable. On the other hand, when the axis-separating amount is +15 μm, the SP moving amount is varied as great as −0.1 to −0.3, and the halation width is dispersed as great as 0.5 or more. The fact that the SP moving amount and the halation width are stable at 0.0 (or near 0.0) means that the electron beam passes through the center of the main lens 35M.

Figure 25:
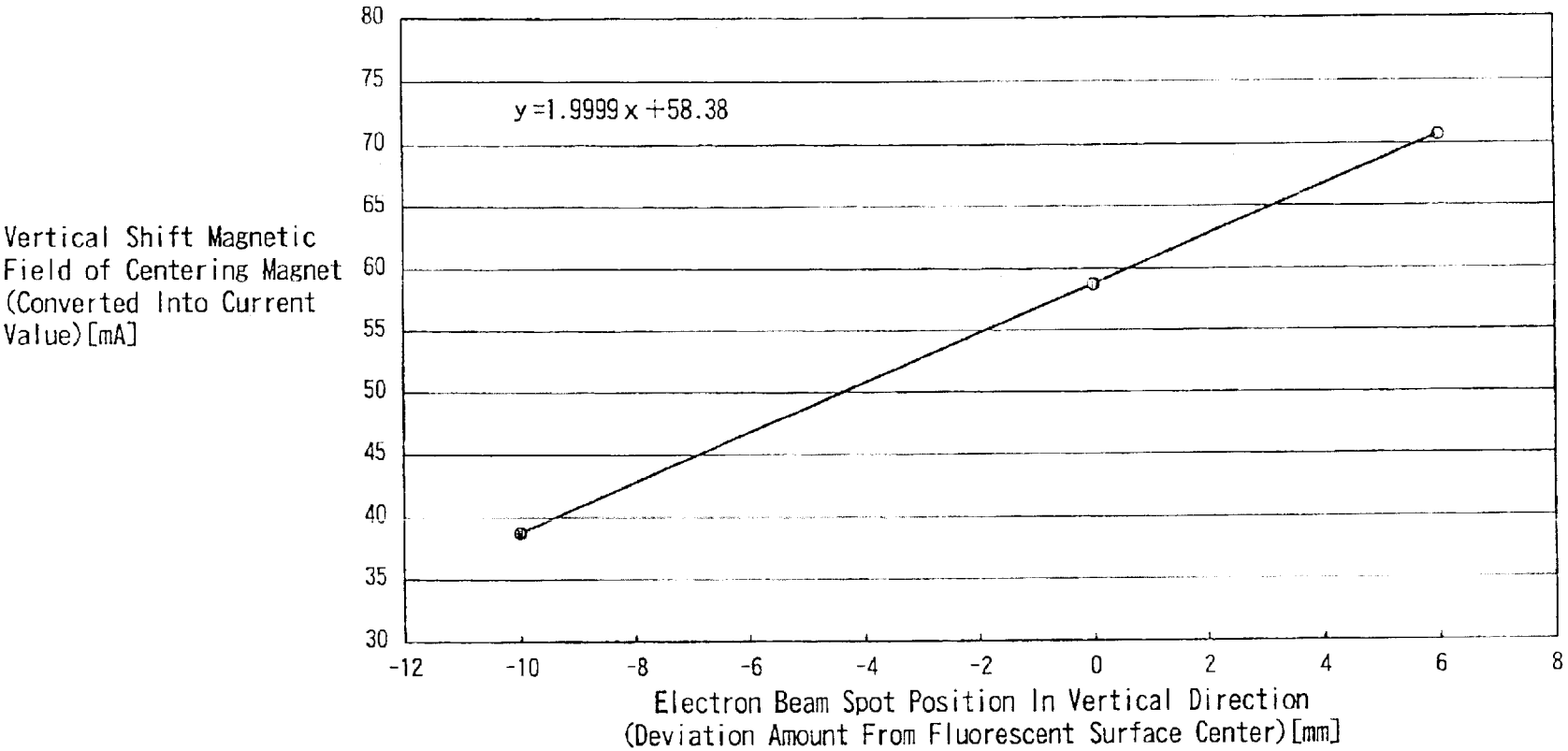
FIG. 25 is a graph showing one example of a correlation between the magnetic field of the centering magnet and a positional deviation amount of the electron beam spot on the fluorescent surface.

FIG. 25 is a graph showing a relation between a magnetic field of the centering magnet and a deviation amount of the electron beam spot position, i.e., a correlation between the magnetic field and the positional deviation amount of the beam spot. A lateral axis shows an electron beam spot position (so-called deviation amount from a center of the fluorescent surface: unit is mm) in a vertical direction of the screen, and a vertical axis shows a value (unit is mA) a vertical shift magnetic field of the centering magnet converted by a current value. From this graph, it can be found that the magnetic field of the centering magnet affects the positional deviation of the electron beam.

TABLE 2

| | Present invention | Prior art |
|---|---|---|
| Halation defect rate | 0% | 10 to 15% |

Table 2 shows a result of study of a defect rate of halation of the beam spot in a conventional flat cathode-ray tube and the flat cathode-ray tube produced by the present invention. As shown in Table 2, in the flat cathode-ray tube of the present invention in which the axis of the electron beam through hole hG2 of the second grid G2 was separated, the halation defective generation rate was 0%, and in the conventional flat cathode-ray tube, the defective generation rate was 10 to 15%. Incidentally, in the flat cathode-ray tube of the present invention, the number of defective tubes was zero (defective generation rate was 0%) among 423 cathode-ray tubes, and in the conventional flat cathode-ray tube, the number of defective tubes was 239 among 1885 cathode-ray tubes (defective generation rate was 12.7%). In the flat cathode-ray tube of the present invention, excellent result was obtained.

In the above examples, the present invention is applied to the bipotential type electron gun and to the flat cathode-ray tube having this electron gun, but the invention can also be applied to a unipotential type electron gun and a flat cathode-ray tube having such an electron gun.

Although the axis-separation of the electron beam caused by an effect of the magnetic field of the centering magnet 33 was corrected by the structure of the electron gun in the above examples, the present invention can also be applied to a case in which the electron beam is separated by an effect of a magnetic field of another magnet disposed outside the neck or another location instead of the centering magnet 33.

EFFECT OF THE INVENTION

According to the flat cathode-ray tube of the invention, by separating an axis of the prefocus lens in a direction in which the axis-separating amount of the electron beam caused by the magnetic field of the magnet becomes smaller, the electron beam whose axis is separated can be corrected, and even if the electron beam receives effect of the magnetic field of the magnet, it is possible to allow the electron beam to pass through the center of the main focus lens. As a result, halation caused by coma aberration can be eliminated, and the resolution can be enhanced.

When the flat cathode-ray tube is constituted such that the electron beam at the time of non-deflection is irradiated on a screen inoperative portion except a frit junction portion of a tube body, the frit junction portion is not deteriorated, the durability is excellent, and the reliability of the flat cathode-ray tube can further be enhanced.

According to the electron gun for the flat cathode-ray tube of the invention, an axis of the prefocus lens is separated in a direction in which the axis-separating amount of the electron beam caused by the magnetic field of the magnet disposed outside the neck becomes smaller. Therefore, it is possible to eliminate the effect of the axis-separation of the electron beam caused by the magnetic field from the magnet when the electron gun is incorporated into the flat cathode-ray tube. Thus, the resolution of the flat cathode-ray tube can be enhanced.

According to the electron gun for the flat cathode-ray tube of the invention, the center of the electron beam through hole of the second grid is separated, and the end surface having the electron beam of the second grid is inclined. Thus, the axis of the prefocus lens can be separated. Therefore, it is possible to eliminate the effect of the axis-separation of the electron beam caused by the magnetic field from the magnet, excellent beam spot can be obtained, and the resolution of the flat cathode-ray tube can be enhanced.

When the axis-separating amount of the electron beam through hole of the second grid is set to 0 to −30 $\mu$m (0 is not included), the moving amount of the electron beam spot and the halation width can be made as small as possible toward 0, and they can be stabilized.

According to the producing method of the electron gun for the flat cathode-ray tube of the invention, the axis-separation of the electron beam caused by the above-described electron gun, i.e., the magnetic field of the magnet can be corrected, and it is possible to easily produce the electron gun capable of obtaining excellent beam spot.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. An electron gun for a flat cathode-ray tube comprising a cathode and a plurality of grids, characterized in that a prefocus lens is separated from a center axis of an electron gun in a direction in which an axis-separating amount of an electron beam caused by a magnetic field of a magnet which is disposed outside of a neck becomes smaller; and means for correcting the electron beam whose axis is separated so that said electron beam passes through a center of a main focus lens, whereupon halation caused by coma aberration is reduced and resolution is enhanced.

2. An electron gun for a flat cathode-ray tube comprising a cathode and a plurality of grids, characterized in that a prefocus lens is separate from a center axis of an electron gun in a direction in which an axis-separating amount of an electron beam caused by a magnetic field of a magnet which is disposed outside of a neck becomes small, and further characterized in that centers of electron beam through holes of first and third grids of the plurality of grids coincide with a center axis of the electron gun, and a center of an electron beam through hole of second grid is separated from the center axis.

3. The electron gun for the flat cathode-ray tube according to claim 2, characterized in that an axis-separating amount of the center of the electron beam through hole of the second grid is 0 to −30 1 $\mu$m (0 is not included).

4. An electron gun for a flat cathode-ray tube, characterized in that a prefocus lens is separated from a center axis of an electron gun in a direction in which an axis-separating amount of an electron beam caused by a magnetic filed of a magnet which is disposed outside of a neck becomes smaller, and further characterized in that centers of electron beam through holes of first and third grids of the plurality of grids coincide with a center axis of the-electron gun, and an end surface having an electron beam through hole of a second grid is inclined with respect to the center axis.

5. The electron gun for the flat cathode-ray tube according to claim 2 wherein said first grid has an electron beam through hole formed at a reference position, and further comprising a second grid having an electron beam through hole separated from a reference position by a predetermined distance and having a positioning hole formed at another reference position, said positioning holes in said first and second grids being sized to receive position means therein so that a spacer is interposed between the first and second grids.

6. The electron gun for the flat cathode-ray rube according to claim 5, wherein said positioning means positions the first and second grids such that an end surface having an electron beam through hole of the second grid is inclined with respect to the first grid in a state that a tapered spacer is interposed between the first and second grids.

* * * * *

UNITED STATES PATENT AND TRADEMARK OFFICE

CERTIFICATE OF CORRECTION

PATENT NO. : 6,710,533 B2
DATED : March 23, 2004
INVENTOR(S) : Jun Miura et al.

It is certified that error appears in the above-identified patent and that said Letters Patent is hereby corrected as shown below:

Column 12,
Line 65, replace "- 30 1 $\mu$m" with -- -30 $\mu$m --.

Column 13,
Line 2, change "filed" to -- field --;
Line 6, change "the-electron" to -- the electron --.

Signed and Sealed this

Thirtieth Day of November, 2004

JON W. DUDAS
*Director of the United States Patent and Trademark Office*